US010916098B2

(12) United States Patent
Lamb

(10) Patent No.: US 10,916,098 B2
(45) **Date of Patent: *Feb. 9, 2021**

(54) SYSTEMS AND METHODS FOR ENHANCING GAMING PAYOUTS

(71) Applicant: KING SHOW GAMES, INC., Minnetonka, MN (US)

(72) Inventor: Jacob Lamb, Maple Grove, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/564,600

(22) Filed: Sep. 9, 2019

(65) Prior Publication Data

US 2019/0392682 A1 Dec. 26, 2019

Related U.S. Application Data

(63) Continuation of application No. 15/655,970, filed on Jul. 21, 2017, now Pat. No. 10,453,304.

(60) Provisional application No. 62/419,397, filed on Nov. 8, 2016.

(51) Int. Cl.
*G07F 17/32* (2006.01)

(52) U.S. Cl.
CPC ..... *G07F 17/3262* (2013.01); *G07F 17/3213* (2013.01); *G07F 17/3244* (2013.01); *G07F 17/3288* (2013.01)

(58) Field of Classification Search
CPC ..... G07F 17/3262; G07F 17/3244; G07F 17/3213; G07F 17/3288
USPC ..... 463/16–20
See application file for complete search history.

(56) References Cited

U.S. PATENT DOCUMENTS

| | | | | |
|---|---|---|---|---|
| 6,869,360 | B2 | 3/2005 | Marks et al. | |
| 8,328,634 | B2 | 12/2012 | Gauselmann | |
| 2006/0258426 | A1 | 11/2006 | Seelig et al. | |
| 2010/0279760 | A1 | 11/2010 | Sugiyama | |
| 2010/0298041 | A1 | 11/2010 | Berman et al. | |
| 2011/0190044 | A1 | 8/2011 | Berman et al. | |
| 2013/0084937 | A1 | 4/2013 | Vann | |
| 2013/0217457 | A1 | 8/2013 | Jarvis et al. | |
| 2013/0344939 | A1 | 12/2013 | Aoki et al. | |
| 2015/0011282 | A1 | 1/2015 | Berman | |
| 2015/0235522 | A1 | 8/2015 | Waal et al. | |
| 2016/0328910 | A1 | 11/2016 | Shaik | |
| 2017/0165573 | A1* | 6/2017 | Froy | A63F 13/426 |
| 2018/0130305 | A1 | 5/2018 | Berman et al. | |
| 2018/0130308 | A1* | 5/2018 | Berman | G07F 17/3269 |
| 2019/0005780 | A1* | 1/2019 | Nelson | G07F 17/326 |

OTHER PUBLICATIONS

IGT, "Ocean Magic Class III Video Slot Machine", Casino Journal, Nov. 2, 2016.

* cited by examiner

*Primary Examiner* — Michael A Cuff

(57) ABSTRACT

Systems, apparatuses and methods for enhancing payouts in gaming activities. One or more payout modifiers may be presented in the game play area, where portions of the game play area identified by the one or more payout modifiers are made eligible for award enhancement for awards occurring on paylines or other pay areas that pass through or otherwise use the identified portions of the game play area that are currently eligible for the award enhancement. In various embodiments, the payout modifiers may identify different volumes of the portions of the game play area to be eligible for the award enhancement, and/or may move about the play area, and/or intersect to form new and potentially more lucrative payout modifiers.

20 Claims, 18 Drawing Sheets

SYSTEMS AND METHODS FOR ENHANCING GAMING PAYOUTS

CROSS REFERENCE TO RELATED APPLICATIONS

This application is a continuation of U.S. application Ser. No. 15/655,970, filed on Jul. 21, 2017, which claims the benefit of U.S. Provisional Patent Application No. 62/419,397, filed on Nov. 8, 2016, to which priority is claimed pursuant to 35 U.S.C. § 119(e) and which is incorporated herein by reference in its entirety.

FIELD

This disclosure relates generally to games, and more particularly to systems, apparatuses and methods for implementing positionally dependent or positionally progressive modifiers or other enhancement values, such as multipliers.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever-wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and that provide advantages over the prior art.

SUMMARY

The present disclosure is directed to systems, apparatuses, computer-readable media, and/or methods that involve or otherwise facilitate positionally dependent payout modifiers in gaming activities.

In accordance with one embodiment, a gaming device is provided for playing a game, which includes at least a display, a user interface, and a processor. The display presents an array of symbol locations, each capable of presenting at least one symbol for each gaming event of the game. The user interface is configured to receive input to initiate the gaming events. The processor is configured to recognize multiple paylines on which the presented symbols are capable of forming winning patterns with respective payouts. The processor is further configured to present a payout modifier identifying at least two adjacent symbol locations, to determine the winning patterns of symbols and the respective payouts on the paylines that implicate at least one of the identified adjacent symbol locations, and to modify the payout on the paylines that implicate at least one of the identified adjacent symbol locations by an amount specified by the payout modifier.

In a further embodiment of such a gaming device, the processor is further configured to move the payout modifier to a new position along a path in the array of symbol locations on a successive one of the gaming events, to identify at least two adjacent symbol locations.

In another embodiment, the processor is further configured to present an additional payout modifier(s) respectively identifying at least two adjacent symbol locations, to modify the payout on the paylines that implicate at least one of the identified adjacent symbol locations by an amount specified by the respective additional payout modifier, and to move each of the payout modifier and the additional payout modifier(s) in respective paths on each successive gaming event. A further variation involves creating a new payout modifier if the payout modifier and the additional payout modifier(s) intersect as they move in their respective paths.

In another embodiment of such a gaming device, the processor is configured to present the payout modifier as a multiplier value on a border of two adjacent symbol locations, and to multiply the payout on the paylines that implicate at least one of the two adjacent symbol locations by the multiplier value. In a particular embodiment, the processor is configured to present the payout modifier as a multiplier value on an intersection of four adjacent symbol locations, and to increase the payout on the paylines that implicate at least one of the four adjacent symbol locations by the multiplier value. In another particular embodiment, the processor is configured to present one or more additional payout modifiers respectively identifying at least two adjacent symbol locations, and to increase the payout on the paylines that implicate at least one of the identified adjacent symbol locations by an amount specified by the respective additional payout modifier.

Another embodiment of a gaming device includes at least a display to present an array of display segments for presenting game symbols, a user interface for receiving input to initiate gaming events, and a processor. On a first succession of the gaming events, the processor is configured to move a first payout modifier along a first path of the display segments, and to implicate at least one of the display segments along the first path, until the first payout modifier has moved to a first termination position. The first payout modifier is then applied to payouts occurring on the paylines involving the implicated display segments along the first path. On a second succession of the gaming events, the processor is configured to move a second payout modifier along a second path of the display segments, and to implicate at least one of the display segments along the second path, until the second payout modifier has moved to a second termination position. The second payout modifier is then applied to payouts occurring on the paylines involving the implicated display segments along the second path.

In a more particular embodiment of such a gaming device, the processor is further configured to create a new payout modifier for display segments subject to an intersection of the first and second payout modifiers, and to apply the new payout modifier to payouts on the paylines involving the display segments subject to the intersection of the first and second payout modifiers. A more particular embodiment involves creating the new payout modifier as a mathematical function of at least the first and second payout modifiers. Another particular embodiment involves the processor being configured to position the new payout modifier on an adjoining boundary of a plurality of the display segments to create an area of influence, and to apply the new payout modifier to payouts occurring on the paylines where the payline passes through any of the area of influence.

In another particular exemplary embodiment of such a gaming device, the first payout modifier is positioned on a first border of the display segments along the first path for each of the gaming events of the first succession, and the processor is configured to implicate a plurality of the display segments along the first path that share the first border. A more particular embodiment involves positioning the second payout modifier on a second border of the display segments along the second path for each of the gaming events of the second succession, where the processor is configured to implicate a plurality of the display segments along the second path that share the second border. In yet another embodiment, the first payout modifier is positioned on a first intersection of three or more display segments along the first path for each of the gaming events of the first succession, and the processor implicates the three or more display segments along the first path that share the first intersection.

Any number of modifiers may be used in connection with such a gaming device. In one embodiment, the processor is configured to move an $n^{th}$ payout modifier along an $n^{th}$ path of the display segments on an $n^{th}$ succession of the gaming events, and to implicate at least one of the display segments along the $n^{th}$ path, until the $n^{th}$ payout modifier has moved to an $n^{th}$ termination position, and to apply the $n^{th}$ payout modifier to payouts occurring on the paylines involving the implicated display segments along the $n^{th}$ path.

In another embodiment, a gaming device for playing a game is provided, which includes at least a display for presenting a grid of display segments capable of presenting symbols thereon, a user interface to receive input to initiate the gaming events, and a processor. In this embodiment, the processor is configured to associate a payout modifier with at least one display segment in connection with one of the gaming events, apply the payout modifier to payouts occurring on any of the paylines traversing the display segment(s) on which the payout modifier is associated, move the payout modifier on successive gaming events to next positions in the array along a path, and apply the payout modifier to the payouts occurring on any of the paylines passing through at least one display segment where the payout modifier has moved, until the payout modifier has moved beyond a final position in the array along the path.

More particular embodiments of such a gaming device include modifying the processor to associate the payout modifier with two of the display segments, where the display presents the payout modifier on a shared border of the two display segments. In an alternate embodiment, the processor may be configured to associate the payout modifier with four of the display segments, where the display presents the payout modifier on a shared intersection of the four display segments.

In another particular embodiment of such a gaming device, the processor is configured to associate the payout modifier with a first set of multiple display segments in connection with one of the gaming events, and to apply the payout modifier to the payouts occurring on any of the paylines traversing at least one of the multiple display segments on which the payout modifier is associated. In this embodiment the processor is further configured to move the payout modifier on successive gaming events to associate the moved payout modifier with respective subsequent sets of multiple display segments in next positions in the array along the path, and to apply the payout modifier to the payouts occurring on any of the paylines passing through at least one of the multiple display segments where the payout modifier has moved, until the payout modifier has moved beyond a final position in the array along the path.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter

DETAILED DESCRIPTION

Figure 1:
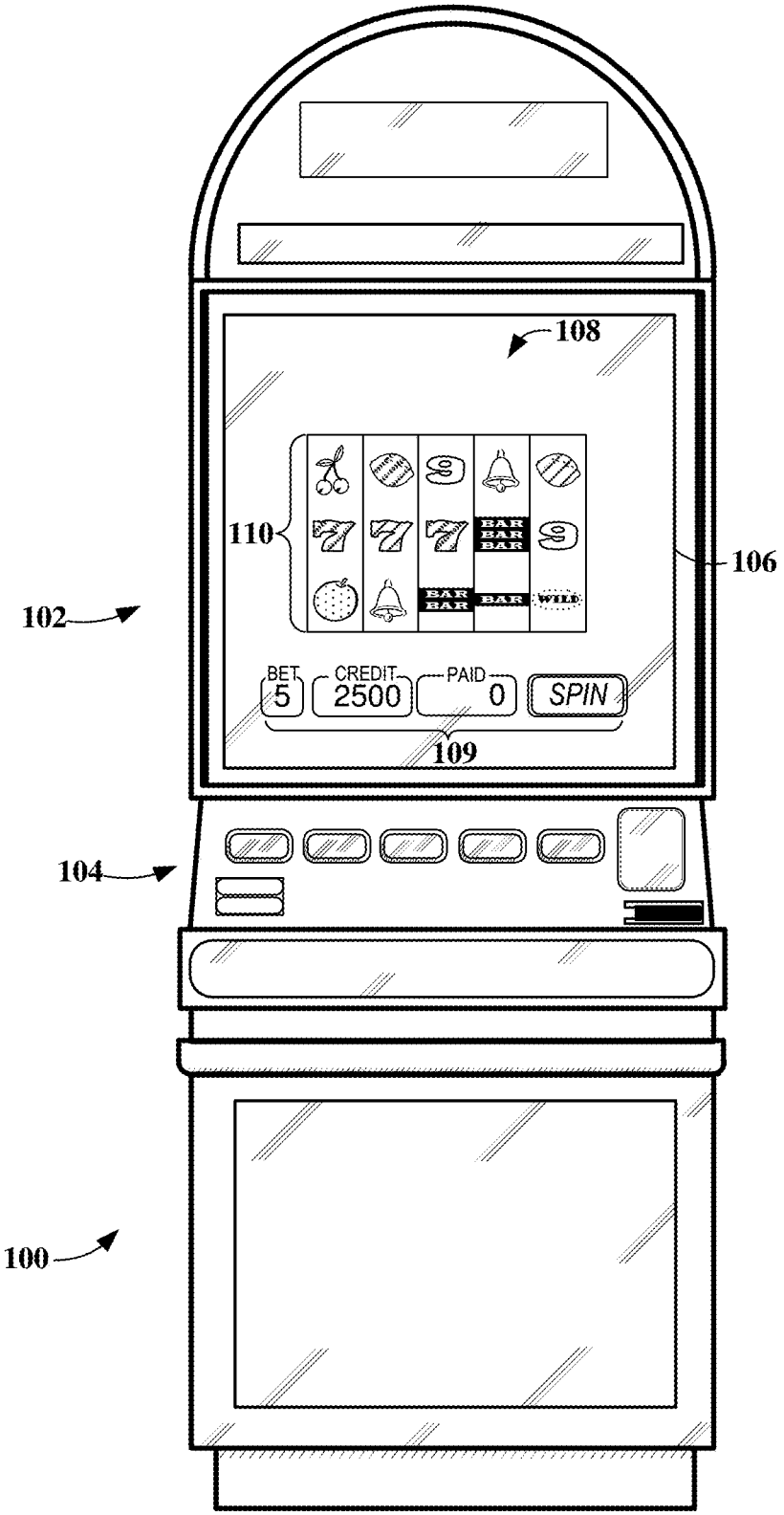
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for implementing positionally progressive award modifiers in gaming activities. These award modifiers, such as award enhancement values, may include random numeric values, set numeric values, mathematical functions, and/or any other value capable of impacting a payout value. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that utilizes operations of implementing positionally progressive multipliers and other enhancement values. In one embodiment described in terms of a slot game, a method of operating a gaming device includes determining, on any spin, determining whether a multiplier is generated at first location of the reel area, such as on the border of the reel area, and/or at the intersection of two adjacent symbol locations. In some embodiments, any payout in the slot game (or other game) that is bordered by (or is otherwise in a physical area of influence) one or more multipliers will have that one or more multiplier applied. During each subsequent spin in this particular embodiment, the multiplier moves a predetermined number of symbols in a direction and/or along a predefined or random path, such as one symbol towards the opposite side of game grid, until eventually reaching an end point such as an opposite side of the game grid, where it is then removed from further play. In some embodiments, multipliers or other enhancement values that cross one another may be summed, multiplied, or otherwise used together to create larger multipliers/enhancement values, where in other embodiments crossing or intersecting modifiers may result in reduced modification, free plays, higher probability reel strips, etc. In one embodiment, a symbol that is bordered by more than one multiplier may have both multipliers applied to any pays it contributes to.

Numerous variations are possible in view of these and other embodiments of the inventive concept. Some representative embodiments and variations are described herein, and some are described below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
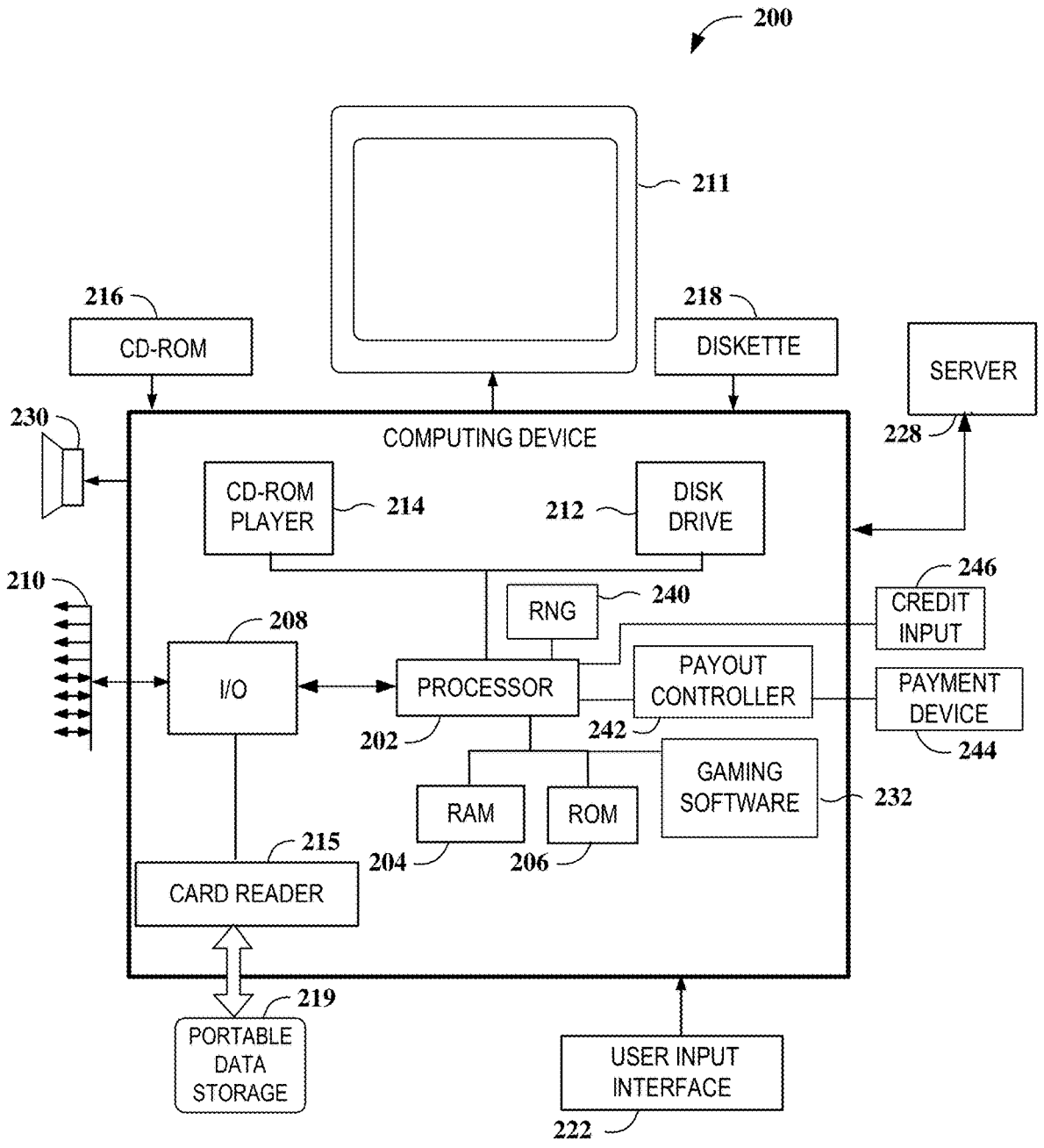
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, one or more enhancement values or other value modifiers, such as multipliers, can be introduced on a playing area, and move across the play area in a stepwise manner across multiple games or gaming events, on successive gaming events associated with the gaming activity. Such modifiers may therefore travel across the grid or other play area, whereby such modifiers are progressively positioned across the grid/play area.

Stated differently, a modifier or other payout enhancement symbol (e.g., multiplier) may be introduced at a first position, which migrates across the reels to at least a second position, and potentially more positions. Any winning payline (or other qualifying payline that meets some qualifying criteria) going through the symbol positions bordering the enhancement symbol are, in some embodiments, advantageously impacted by the enhancement symbol. In some embodiments, intersecting enhancement symbols result in an increased enhancement value. In other embodiments, intersecting enhancement symbols may result in winning progressive jackpots, free plays, improved or "richer" reel strips, etc. In other embodiments, the migration may change upon the occurrence of intersecting modifiers, such as, for example, slowing the migration of the modifier(s) to enable the modifier(s) to be applied for a longer duration or greater number of gaming events (e.g., migrates every other spin, or every nth spin, in a slot game), or for a shorter duration or fewer number of gaming events, and/or other feature that changes from the pre-intersection state of the modifier(s).

In other embodiments, the value modifier(s) may move about the play area in a non-stepwise fashion, such as in a pattern (e.g., two locations forward, followed by one location back, followed by two steps forward, etc.), or even in a random or seemingly unpredictable manner. Other embodiments may also involve the modifier(s) moving in a non-successive manner, whereby the movement of the value modifier(s) does not necessarily move in connection with every gaming event, but rather moves at times in a pattern (e.g., every other gaming event), at random times, every time an event occurs (e.g., no win on any payline), etc.

Other particular variations include a payout enhancement symbol (e.g., multiplier, add-on, wild symbol, etc.) that is introduced at a first position (e.g., reel border) and migrates (e.g., per spin; based on time, etc.) across the reels (e.g., in a predetermined pattern, such as a line, L-shape, box, etc.) until reaching a termination point. Winning and/or other qualifying paylines traversing the symbol positions touching the enhancement symbol may have their win amounts increased by an amount specified or otherwise determinable by the enhancement/modifier symbol (e.g., a modifier having a 3× displayed may apply a multiplication of three to payouts on the relevant payline(s)). In some embodiments, intersecting enhancement symbols result in an increased enhancement, such as multiplying, adding or otherwise using the intersecting plurality of modifiers to arrive at an increased modifier.

Thus, some embodiments involve identifying an area of influence with the positioning of the modifiers, such as creating a four-display-segment area of influence when a modifier becomes positioned at the intersection of the four symbol locations (i.e. locations for symbol placement, also referred to herein as display segments) in a slot game. This area of influence, i.e. the four symbol locations, is influenced by having paylines traversing or otherwise involving these four symbol locations to be enhanced by the modifier that identified the area of influence. For example, a 3× multiplier positioned at the intersection of four symbol locations of a slot game may multiply any winning result on the impacted paylines by three. On subsequent spins or other gaming events of such a slot game, the 3× multiplier may travel, such as in a stepwise fashion across the slot grid, to create new areas of influence as it travels.

Intersecting multipliers, such as multipliers traveling orthogonally to one another and reaching a common position, may enhance the affected paylines using each of the intersecting multipliers individually and/or an enhanced value derived from some interaction with the involved intersecting multipliers (e.g., multiplying a 2× and 3× multiplier to provide a 6× multiplier). Thus, in some embodiments, intersecting multipliers may provide an increasing effect such as, for example, adding the intersecting multipliers, multiplying the multipliers, using one multiplier as a base and the other as an exponent, or any other mathematical function desired.

In some embodiments, intersecting modifiers may instead cause a reduced modifier value, such as subtracting modifiers (e.g., intersecting 6× and 9× multipliers create a 3× multiplier), dividing modifiers (e.g., intersecting 6× and 3× multipliers create a 2× multiplier), etc. Such non-enhancing operations may be applied randomly, or when some predetermined event(s) occurs, or always, etc.

Many embodiments herein will be described in terms of a slot game, where symbols are matched on paylines to determine payout awards. However, the principles described herein are equally applicable to other games of chance, as described herein and as will be readily apparent to those skilled in the art from the teachings herein. In a slot game embodiment, a player may be provided a chance(s) that a multiplier(s) or other modifier(s) will be generated on the border of the reel area of a slot game, at the intersection of two or more adjacent symbol locations during a gaming event. In such an embodiment, any pay that is bordered by one or more multipliers may have that multiplier applied. During subsequent spins (e.g., consecutive, or in other embodiments non-consecutive), the multiplier moves one symbol towards the opposite side of the game array or grid, eventually reaching a termination point such as the other side of the game grid, and then is removed from play or otherwise discontinued. Multipliers or other modifiers that cross one another, overlap, or otherwise interact with one another may be summed, multiplied or otherwise enhanced to create larger multipliers or modifiers. A symbol that is bordered by more than one multiplier/modifier may have both multipliers/modifiers applied to any pays it contributes to.

Figure 3:
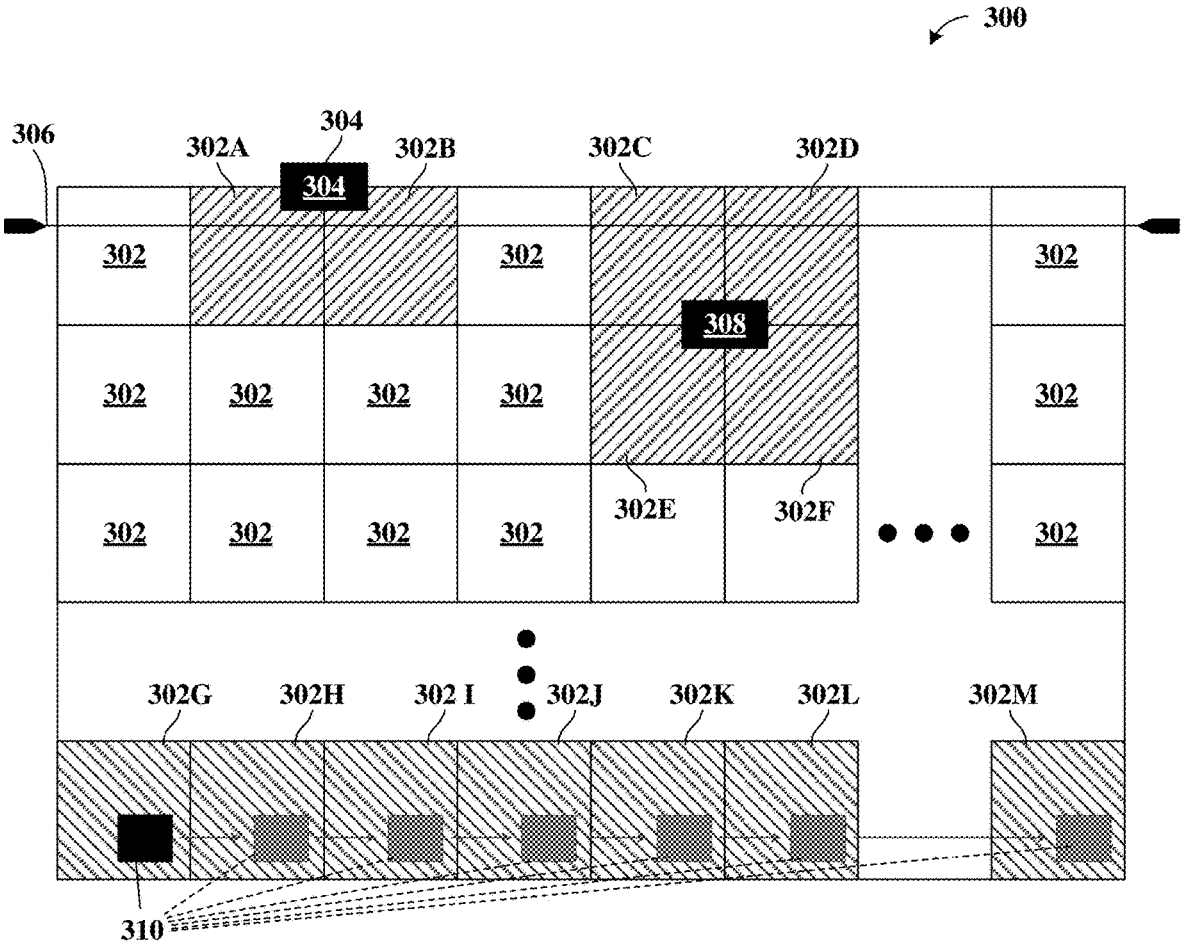
FIG. 3 is a block diagram of a gaming grid depicting an embodiment where payout modifiers influence paylines on bordering slot display segments.

FIG. 3 is described in the context of such a slot game embodiment. This embodiment depicts modifiers that influence paylines on bordering slot display segments or "symbol locations," as well as an example of a progressive migration of modifiers spanning multiple spins or other gaming events. However, these principles are applicable to any game of chance.

As shown in FIG. 3, a game play area or "grid" 300 includes a plurality of symbol locations symbol locations 302 where game symbols or other indicia may be presented. The display segments 302 or "symbol locations" are arranged in a rectangular array or grid of rows and columns in the illustrated embodiment, although any pattern may be implemented. In one embodiment, an enhancement value 304 or "modifier" is positioned such that it borders, touches, or is otherwise perceptibly associated with one or more symbol locations 302, such as symbol locations 302A and 302B. In the illustrated embodiment, the modifier 304 is positioned such that it contacts the symbol locations 302A and 302B to which it affects, and spans the common border between the symbol locations 302A and. 302B. The modifier 304 may randomly arise at the position shown in FIG. 3. The modifier 304 may randomly originate at any position of the grid, but in one embodiment the modifier 304 and other modifiers originate at the most external borders of the grid 300. The modifier 304, such as a multiplier, affects pay lines to which the influenced symbol locations 302A and 302B are a part. For example, if symbol locations 302A and 302B are part of a payline 306 along the top row of symbol locations 302, a winning payout on that payline 306 can be modified by, or in most cases enhanced by, the modifier 304. More particularly, if the symbols presented in the symbol locations 302 of an implicated payline 306 resulted in a ten-credit win, and the modifier 304 was a 4× multiplier, the ten-credit win would be enhanced to result in a forty-credit win (4 times 10 credits). Further, if symbol locations 302A and 302B were associated with different winning paylines, the modifier 304 may be applied to the winning payouts on each of the winning payouts for paylines to which symbol locations 302A and 302B form a part. In this manner, modifiers positioned to influence a plurality of symbol locations 302 can be used to enhance a plurality of standard payline payouts.

The example of FIG. 3 also depicts an example of a modifier 308 that influences even a larger number of symbol locations 302, particularly symbol locations 302C, 302D, 302E, and 302F. Analogously to the previous example, the modifier 308, such as a multiplier, influences a plurality of symbol locations, such that paylines involving any of the symbol locations 302C, 302D, 302E, or 302F may be enhanced by the modifier 308. In one embodiment, modifier 308 originates at an external border of the grid 300, and is depicted in FIG. 3 at an intermediate stage where it has traveled from its original position on the grid 300 to its current position. As can be seen, as a modifier 304, 308 travels across the grid 300, it may influence a different number of symbol locations 302. In one embodiment, the modifiers 304, 308 travel in a stepwise fashion to a next symbol location intersection at each distinct spin or other gaming event.

In still other embodiments, a modifier 310 may be associated with a single symbol location 302G. As in previous examples, the modifier 310 may originate at a display segment 302 at the external boundary of the grid 300, and traverse the grid 300 from that point. In the illustrated example, the modifier 310 travels in a stepwise fashion on each spin to the next symbol locations 302H, 302I, 302J, 302K, 302L, through 302M, as depicted by the progression of the modifier 310. As the modifier 310 travels across the grid 300, it influences a corresponding display segment 302, and paylines involving that particular display segment 302G-302M can have any winning payouts enhanced by the value of the modifier 310.

As noted above, one embodiment involves one or more modifiers, such as multipliers, traversing a grid or other play area at predetermined times or events (such as at each slot game spin) from a first position to at least a second position, and possibly additional positions. For example, a modifier may randomly present itself at the border of a slot game grid, and on each successive spin, move one intersection until reaching a termination point such as an opposite border of the grid. FIG. 4A through FIG. 4G depict the stages of such a representative embodiment. At FIG. 4A, no modifier has yet been presented at the symbol location 402 of the grid 400. Game play symbols (not shown) may be presented in the various symbol locations 402 to provide payouts on any number of paylines associated with the particular game.

Figure 4A:
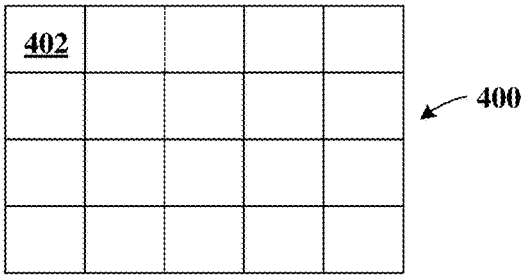
FIGS. 4A-4G depict stages where a payout modifier traverses a grid in the context of a slot game.
Figure 4E:
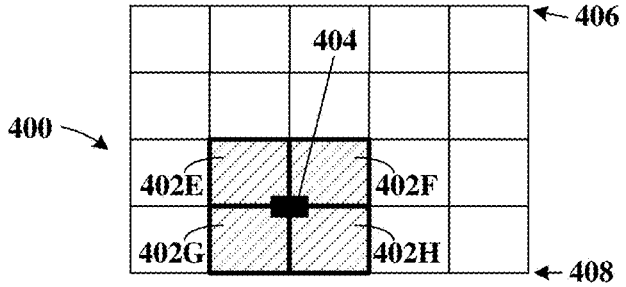
Figure 4B:
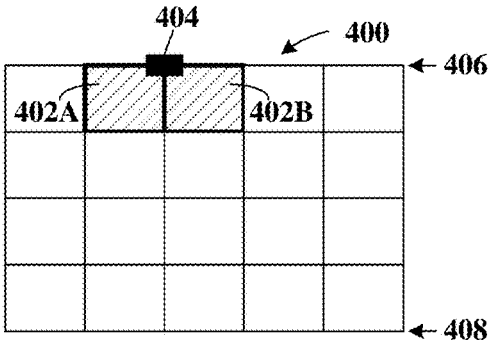

FIG. 4B depicts a subsequent spin of the virtual or physical slot reels, whereby a modifier 404 has randomly presented itself at the top border 406 of the grid 400. The modifier 404 straddles symbol locations 402A and 402B, thereby influencing any paylines in which symbol locations 402A and 402B form a part thereof. On a subsequent spin depicted in FIG. 4C, the modifier 404 has moved one intersection towards an opposite boundary 408 of the grid, creating an area of influence now involving four symbol locations 402A, 402B, 402C and 402D because the modifier straddles the intersecting borders of these symbol locations. Therefore, any winning payouts on paylines implicating symbol locations 402A, 402B, 402C and 402D will be enhanced by the modifier 404. A greater number of symbol locations 402 in the modifier's 404 area of influence may increase the number of potential paylines that can be affected by the modifier.

Figure 4F:
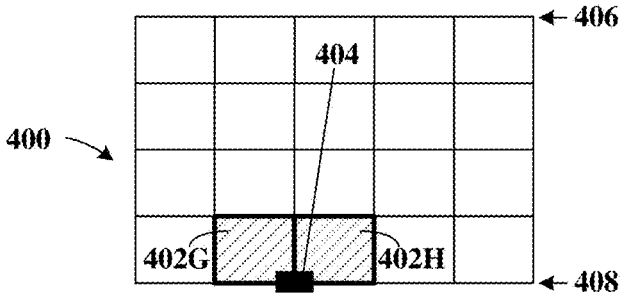
Figure 4C:
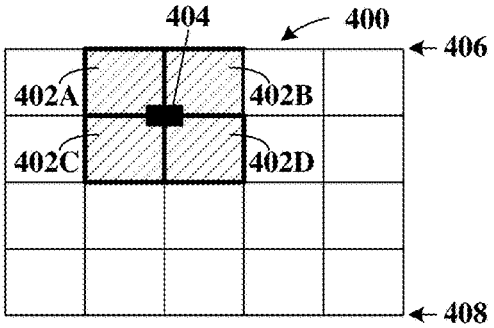
Figure 4G:
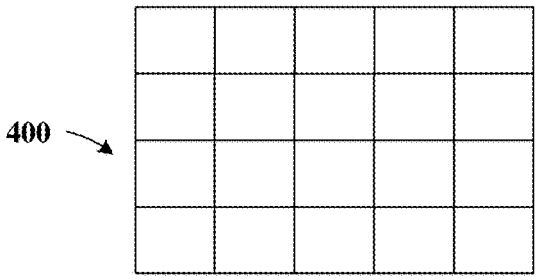
Figure 4D:
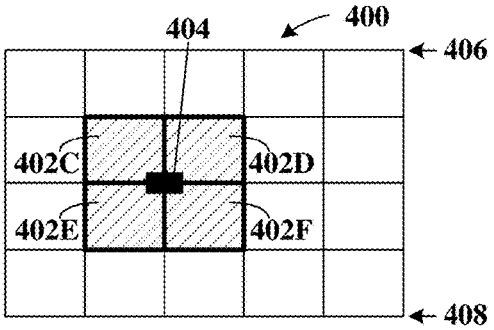

FIGS. 4D and 4E depict the modifier at further steps, such as at the next subsequent spins, or at the next event that has been predetermined to cause the modifier 404 to move (e.g., every nth spin; when no payline has resulted in a winning payout; when any payline has resulted in a winning payout; and/or any other desired criteria). For example, FIG. 4D may represent the next spin of the slot game, where a new area of influence is circumscribed that involves symbol locations 402C, 402D, 402E and 402F. FIG. 4E may then represent the next spin of the slot game, where another new area of influence is circumscribed that involves symbol locations 402E, 402F, 402G and 402H. On yet another subsequent spin, the modifier 404 moves to the final intersection point that straddles symbol locations 402G and 402H as depicted at FIG. 4F, where the area of influence again reduces to only two symbol locations in this example. On the next successive spin, the modifier 404 falls out of play, as depicted at FIG. 4G.

As can be seen by the example of FIG. 4A through FIG. 4G, a modifier 404 may traverse the play grid 400 and a stepwise fashion to influence different groups of symbol locations 402 which in turn are part of different paylines to which the modifier 404 can enhance. In other embodiments, the modifier 404 may traverse the play grid continuously (or in a pattern or even erratically) and therefore does not "step" on each gaming activity, but rather moves over some period of time as gaming activities occur. In various embodiments, the modifier 404 may be generated at any intersection of two or more symbol locations 402. The modifier 404 may move to change the intersection to which it is positioned, thereby changing an area of influence defined by a number of symbol locations 402. The modifier 404 may be randomly generated, such as the random generation of a multiplier or other fixed or dynamic number, mathematical or other function, etc. The modifier 404 may travel from a starting point to an ending point which may or may not involve intermediate stops. As will be described in subsequent examples, a plurality of such modifiers 404 may traverse a play area or grid 400 concurrently, thereby enabling an even greater number of paylines to be impacted, and providing further features such as special enhancements when modifiers travel to a point of intersection.

As noted above, in one embodiment, the modifier(s) (e.g., modifier 404), may steadily or continuously move across or about the grid 400 during play, rather than moving in a stepwise fashion in connection with reel spins or other gaming events. For example, such a time-based embodiment may involve a modifier 404 moving from a starting location (e.g., a first border of the grid 400) to a terminating location (e.g., an opposite border of the grid 400), where the motion is relatively continuous and slow enough to be capable of being active between the starting and terminating points across multiple spins or other gaming events. In some embodiments, the motion of the modifier 404 need not be steady or continuous, but may be any motion (even erratic) where the movement of the modifier(s) 404 can be seen to move about the grid during play of the affected gaming events. As the modifier(s) 404 moves, it may activate two symbol locations when on an intersection of the two symbol locations (e.g., symbol locations 402A, 402B), and activate four symbol locations when on an intersection of the four symbol locations (e.g., symbol locations 402A, 402B, 402C, 402D). Thus, in one embodiment, as time passes during a player's participation in a plurality of gaming events (e.g., spins), the modifier(s) 404 slowly moves across the grid 400 from a starting point to a termination point, activating symbol locations as it goes. If the player wins a payout on a payline(s) during play, the modifier(s) 404 may enhance or otherwise impact the payout if symbol locations activated by the modifier(s) 404 are along the respective payline. In such an embodiment, particular symbol locations 402 may be activated for multiple spins, if the spins occur faster than the modifier(s) 404 travels. In this manner, a player may choose to play the game faster in an attempt to get as many opportunities to win as possible in the time that the modifier(s) 404 moves across or about the grid 400.

Figure 5:
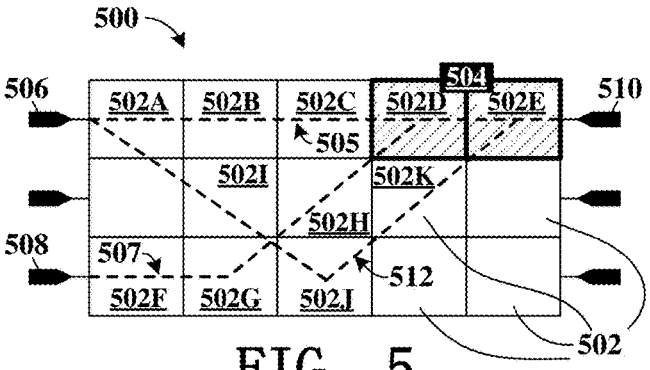
FIG. 5 illustrates a slot game depicting how awards associated with paylines within an area of influence of the nearby modifier may be modified.

FIG. 5 depicts an exemplary slot game having a 3×5 grid 500 (i.e. 3 rows and 5 columns) having a plurality of display segments or symbol locations 502 in which symbols or other indicia involved in the game may be presented. The example of FIG. 5 illustrates how awards associated with paylines and/or symbol locations within an area of influence of the nearby modifier may be modified. In this example, modifiers 502D and 502E are associated with the modifier 504, which for this example may be a multiplier value (e.g., 3× multiplier). In the example of FIG. 5, modifier 504 visually contacts the symbol locations 502D, 502E in the area of influence, such as somewhere along the border intersecting these symbol locations 502D, 502E. Modifier 504 need not be presented as indicia that spans multiple symbol locations, but rather may be presented in any fashion that indicates which symbol locations are implicated (e.g., the modifier 504 indicia may be replicated on each of symbol locations 502D, 502E and move as a unit, rather than being presented as indicia contacting/touching each of the symbol locations associated with its area of influence, etc.).

In one embodiment, with symbol locations 502D and 502E being impacted by the presence of modifier 504, the paylines associated with those symbol locations 502D, 502E have any payline awards enhanced or otherwise modified by modifier 504. In the example of FIG. 5, it is assumed that a plurality of predefined paylines are associated with the game, including payline 505 between points 506 and 510 (which includes symbol locations 502A, 502B, 502C, 502D, 502E) and payline 507 between points 508 and 510 (which includes symbol locations 502F, 502G, 502H, 502D, 502E). In one embodiment, since each of these two paylines 505, 507 goes through or otherwise utilizes the impacted symbol locations 502D, 502E, the paylines 505, 507 each qualify to have any award payout modified by the modifier 504. For example, if a number of matching symbols on the payline 505 create a ten-credit payout, and a number of matching symbols on the payline 507 create a twenty-credit payout, and the modifier is a 5× (five times) multiplier, the total win would be increased from thirty credits to one-hundred fifty credits (10×5+20×5=150). This is because each of the paylines 505, 507 passes through the modifier's 504 area of influence, which includes symbol locations 502D and 502E in the illustrated embodiment. In other embodiments, a subset of all paylines involving the activated symbol locations 502D, 502E is enhanced, such as, for example, the largest payout on any of the paylines traversing a display segment within the area of influence defined by the modifier.

In an alternative embodiment, the modifier could be awarded once (or some predetermined number of times) for every display segment within or otherwise associated with the respective payline, versus the respective payline just passing through any of the symbol locations within the modifier's area of influence (area of influence in FIG. 5 includes symbol locations 502D and 502E). Thus, in such an embodiment, where the multiplier is a 5× multiplier and the payline 505 has a ten credit win, the total win for that payline 505 could be ten credits times five (for multiplier's 504 association with display segment 502D) time five again (for multiplier's 504 association with display segment 502E) for a total of two-hundred-fifty credits (10 credits×5 multiplier×5 multiplier=250). Since both symbol locations 502D and 502E fall within the payline 507, a twenty credit win on that payline 507 could also be enhanced using the multiplier 504 twice (once for each display segment on that payline 507). For example, where the 5× multiplier is applied twice to a five-credit symbol award on payline 507, the total payout for payline 507 would be multiplied by five (for multiplier's 504 association with display segment 502D) and multiplied by five again (for multiplier's 504 association with display segment 502E) for a total of one-hundred-twenty-five credits (5 credits×5 multiplier×5 multiplier=125) for payline 507.

FIG. 5 also depicts a payline 512, between points 506 and 510, including symbol locations 502A, 5021, 502J, 502K, 502E. This payline includes display segment 502E, which is within modifier's 504 area of influence. Therefore, in one embodiment, any award received due to standard symbol-based payouts on payline 512 may be modified by the modifier 504, such as multiplied by a multiplier value (pay times three), added to a fixed or random amount (pay plus one-hundred), increased with the modifier serving as an exponent to the win (e.g., pay squared), etc. In such an embodiment, the pay is modified due to the payline 512 simply passing through any of the symbol locations 502D, 502E that are within the modifier's 504 area of influence.

In other embodiments, the modifier 504 can be applied, for example, once for each display segment within the area of influence in which the payline passes. For payline 512, such an embodiment would still only result in the payline 512 award being modified once by modifier 504, since there is only one display segment (502E) within the area of influence that is associated with payline 512, where for paylines 505 and 507 their respective awards could be modified twice by modifier 504 since there are two symbol locations (502D, 502E) within the area of influence that are associated with each of the paylines 505, 507.

In yet another embodiment, the modifier 504 can enhance or otherwise modify payout values that are not associated with a payline. For example, instant awards identified on a display segment may be modified by a modifier that includes that display segment within its area of influence. An example using FIG. 5 may be that a one-hundred credit instant win is awarded via display segment 502D, and since display segment 502D is active for modification by being within the modifier's 504 area of influence, the modifier 504 can modify the one-hundred credit instant win. If the modifier was a 3× multiplier, the one-hundred credit instant win on display segment 502D would be tripled to a total of a three-hundred credit win. This may also apply to other wins available on one or more symbol locations that do not necessarily constitute a "payline" win, such as free spins (e.g., a free spin indicator on display segment 502D with a 5× modifier 504 can result in five free spins), scatter pays (e.g., any scatter pay win having at least one display segment within the modifier's 504 area of influence may be appropriately modified), bonus wins, etc. For example, a bonus may be awarded if the player gets three like star symbols anywhere on the grid 500, and if at least one such star symbol is within the area of influence on symbol locations 502D or 502E, the player may get a modified bonus. The modification to the bonus depends on the modifier 504 value, and could be any desired modification. For example, a 3× modifier 504 may provide three bonus plays instead of just one. Or (or additionally), a 3× modifier 504 may increase the bonus values at play by three (e.g., where potential bonus values ranged from 5 credits to 100 credits, a 3× modifier 504 may increase the range from 15 credits to 300 credits). Thus, awards associated with symbol locations that fall within a modifier's 504 area of influence may be modified, whether the display segment awards are associated with fixed paylines, dynamic paylines, scatter pays, instant awards, bonus plays, or any other desired award possibility that implicates the respective display segment(s) 502.

Figure 6A:
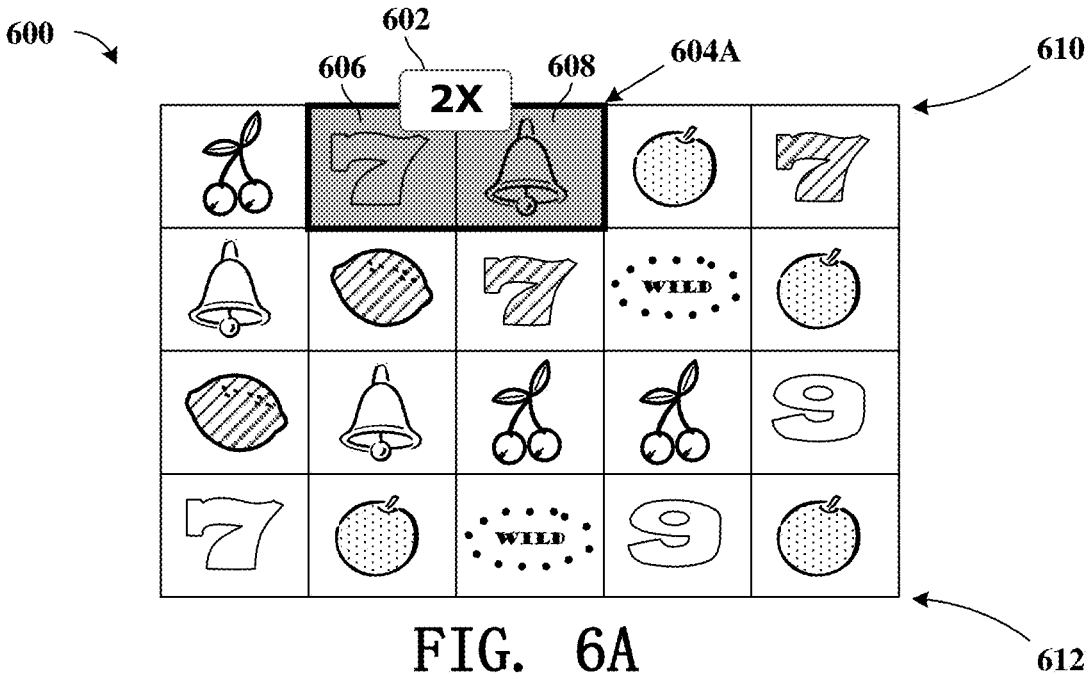
FIGS. 6A and 6B depict a positional progression of a multiplier and its consequent area of influence for payline enhancement in a representative slot game context.
Figure 6B:
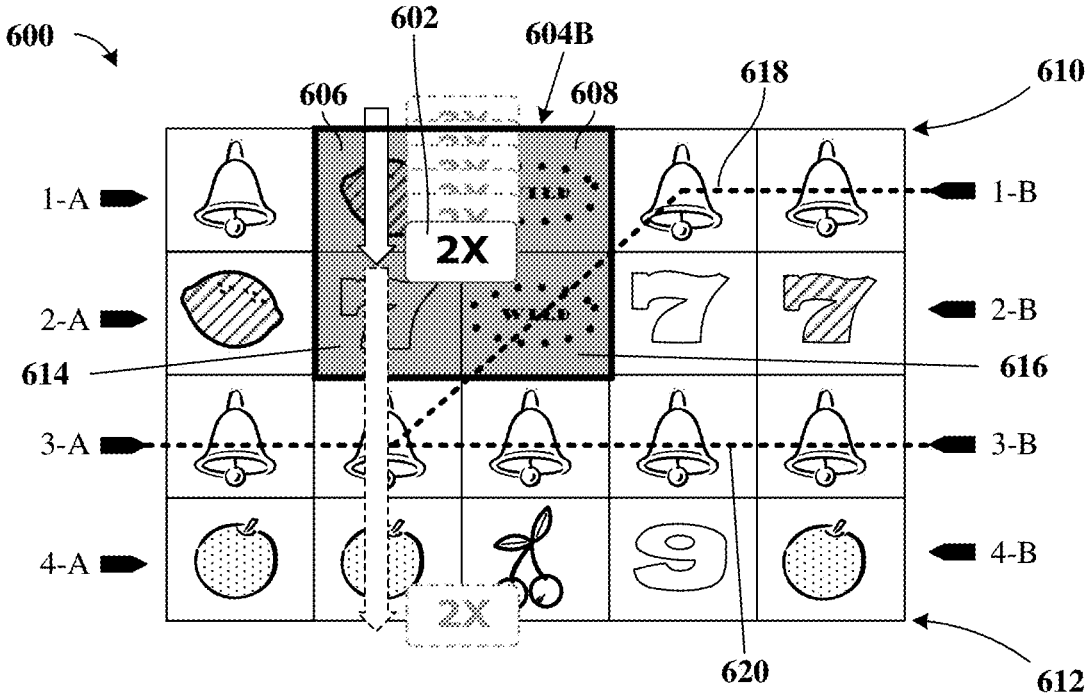

FIGS. 6A and 6B depict an embodiment of game features described herein in the context of a slot game. The example of FIG. 6 depicts how a modifier 602 can randomly originate at some place on the grid. In one embodiment, the modifier 602 randomly materializes at a border, such as the top border 610, of the slot game grid 600. The modifier's 602 random appearance (which may be periodic, planned, etc. in other embodiments) creates an area of influence 604A including the symbol locations 606, 608 that are implicated in the enhanced award possibility by way of their association with the presented modifier 602. In one embodiment, any payline award(s) or other payout award(s) involving at least one of the implicated symbol locations 606, 608 will enable the modifier 602, a 2× multiplier in this example, to be used to enhance the awards. In the example of FIG. 6A, no paylines result in a payout, so the multiplier 602 is not applied to any payout.

FIG. 6B depicts the state of the reels after a subsequent spin occurs. The multiplier 602 has moved from its starting position along the top border 610 to the next intersection of symbol locations along a path to its targeted destination which is the bottom border 612 in this example. By moving in this fashion, the multiplier 602 has created a new area of influence 604B, which now involves symbol locations 606, 608, 614 and 616, by virtue of the multiplier 602 straddling a border of each of these four symbol locations. Therefore, in one embodiment, any paylines passing through the area of influence 604B will have any winning payouts multiplied by the multiplier 602, which is a 2× multiplier in this example. For example, the pay line from point 3-A to point 1-B is defined as a payline 618. In this example, matching symbols along that payline 618 exist (e.g., four bell symbols plus one wild symbol), thereby resulting in some winning payout, such as 100 credits. This payout of 100 credits is then multiplied by the multiplier 602, resulting in a total payout of 200 credits in this example.

Paylines having winning payouts that do not pass through the area of influence 604B will not have its payout multiplied or otherwise enhanced by the modifier 602. This is depicted by payline 620, where five bell symbols again results in a payout of (for example) 100 credits, yet the 2× multiplier 602 is not applied to that payout because the payline 620 does not pass through the area of influence 604B created by the current location of the multiplier 602.

In one embodiment, the movement of the multiplier 602 continues as new spins occur. The movement and use of the multiplier 602 may occur for a random or fixed time, a random or fixed number of gaming events, or any other desired criteria. In some embodiments, including the illustrated embodiment of FIG. 6B, movement of the multiplier 602 continues as new spins occur until it reaches a termination point, such as an opposite border 612 of the grid 600. Paylines passing through the moving area of influence 604B can thereby have their respective payouts enhanced or otherwise modified by the modifier 602.

In some embodiments, multiple modifiers may originate or otherwise be present concurrently. For example, two or more modifiers may present themselves at the same time or different times (e.g., on the same or different spins of a slot game), and each migrate across or about the play area concurrently. The movement of the multiple modifiers may be in the same direction, an opposite direction, orthogonal directions, or any direction made possible by the particular game.

Figure 7A:
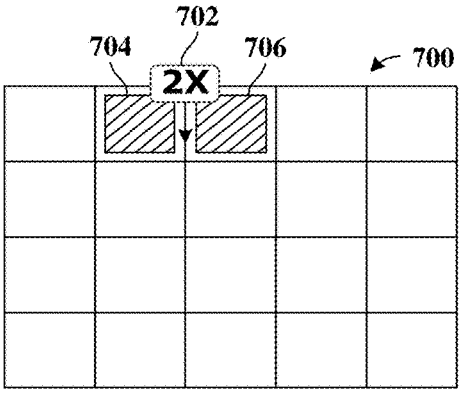
FIGS. 7A-7F depict an embodiment involving multiple modifiers that concurrently migrate across the grid or array of a slot game.

FIGS. 7A-7F depict one such embodiment involving two or more modifiers that concurrently migrate across the grid or other play area of a slot game. FIG. 7A shows a first modifier 702 originating at a first location of the grid 700. In this example, the modifier 702 is a 2× multiplier. The modifier 702 straddles the border of two symbol locations 704, 706, thereby allowing any paylines passing through any (in one embodiment) of the symbol locations 704, 706 to be adjusted by the modifier 702. As previously noted, other embodiments may require a payline to pass through more than one display segment within the area of influence in order to enable the modifier 702 to adjust any payouts on that payline.

Figure 7D:
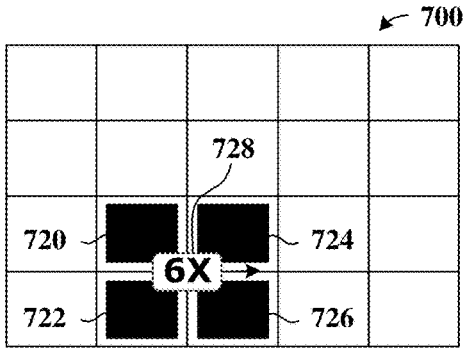
Figure 7B:
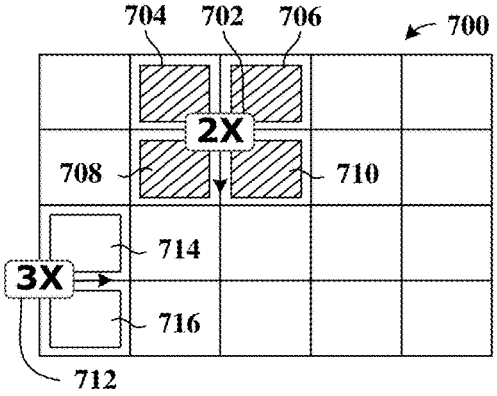

FIG. 7B depicts a subsequent state, such as an immediately ensuing spin of the slot game, where the modifier 702 has moved in a given direction to the next intersection or border along the path that it travels. The modifier 702 therefore straddles four different symbol locations 704, 706, 708, 710, thereby providing a 2X multiplier to any payouts whose paylines pass through the area of influence created by the four symbol locations 704, 706, 708, 710. Also in connection with that particular spin or other gaming event, a second modifier 712 originated at a border of the grid 700, straddling two symbol locations 714, 716. Therefore, any paylines passing through this new area of influence created by the two symbol locations 714, 716 will have their payouts modified by the modifier 712, which is a 3× multiplier in this example.

It should be recognized that a payline could pass through symbol locations associated with different modifiers. For example, a pay line that passed through symbol locations 714 and 708 would be within two distinct areas of influence, created by modifier 712 and 702 respectively. The manner in which payouts on such a particular payline is modified by the multiple modifiers may vary in accordance with the principles described herein. For example, the larger of the modifiers 702, 712 may be utilized to enhance or otherwise modify a payout on a payline passing through both areas of influence.

In another embodiment, some function of the multiple modifiers may be utilized, such as the sum of the two modifiers. In the illustrated example of FIG. 7B, this would result in a 5× multiplier, which is tantamount to applying each of the modifiers 702, 712 independently to the original payout value and counting each as a modified payout result. For example, for a ten credit win on a payline passing through symbol locations 714 and 708, a total win of fifty credits may be won ((2+3)×10)=50 credits). Other mathematical functions may also be used, such as the difference of the multipliers, exponents, etc.

In another embodiment, the payout on the payline passing through multiple different areas of influence is first modified by a first modifier (e.g., modifier 702), and then that result is modified by the second modifier (e.g., modifier 712). For example, if a payline having a payout of ten credits passes through symbol locations 714 and 708 in the example of FIG. 7B, the credits may be first modified by a first one of the modifiers, which could be the left-most modifier, the highest or lowest modifier, or any other criteria. In this example, assume the ten credit payout is modified first by the lowest modifier 702 (the 2× modifier in this example), which is then modified by the 3× multiplier, resulting in a win of sixty credits ((2×10)×3)=60 credits). The order may not matter for some mathematical functions, but may for others (exponents). In yet other embodiments, no modification may be provided when more than one modifier impacts the payline.

In another embodiment, such as that of FIG. 7B, the largest modifier impacting a payline is the modifier to be applied to a payout on that payline. For example, if a payline passes through both display segment 714 and display segment 708 (in two different areas of influence having 3× and 2× modifiers respectively), the largest of those multipliers (3× in this example) is applied to the payout from that payline.

Figure 7E:
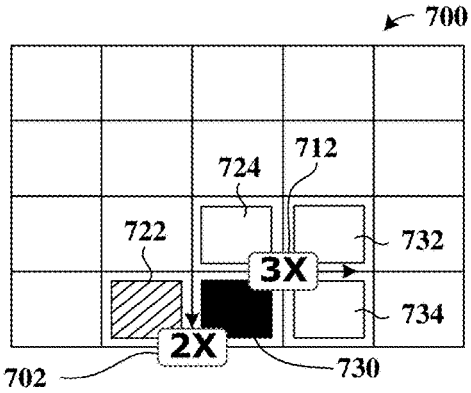
Figure 7C:
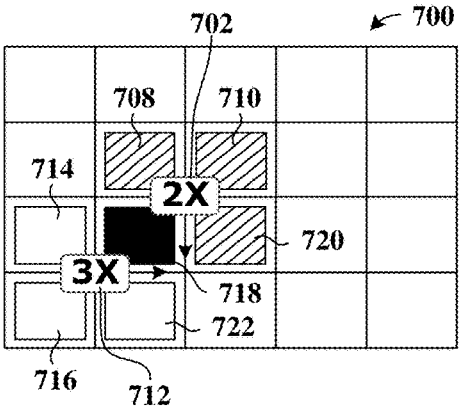

On the next reel spin, FIG. 7C depicts the further migration downward on the grid 700 by modifier 702, and further migration to the right on the grid 700 by modifier 712. The area of influence of each modifier accordingly changes, such that the area of influence of modifier 702 now includes symbol locations 708, 710, 718, 720, while the area of influence of modifier 712 now includes symbol locations 714, 716, 718, 722. The payouts may be modified as previously described for paylines passing through any of the symbol locations within the area of influence of the modifiers 702, 712.

However, as noted in FIG. 7C, the areas of influence can intersect, such that one or more of the symbol locations is actually within multiple areas of influence. In other words, the 3× modifier 712 is on the border of display segment 718 thereby including it in modifier's 712 area of influence, and the 2× modifier 702 is also on the border of display segment 718 thereby including it in modifier's 702 area of influence. In such a case, paylines passing through this display segment 718 impacted by a plurality of modifiers 702, 712 can be modified differently, such as a further enhanced modifier. For example, the modifiers 702, 712 may be mathematically applied, such as multiplying the plurality of modifiers 702, 712 (e.g., 2×3=6×); adding the plurality of modifiers 702, 712 (e.g., 2+3=5×); using one as a base and one as an exponent (e.g., $2^3$=8×); etc.

In one particular embodiment, an enhancement created by multiple modifiers 702, 712 bordering a common display segment 718 will provide a higher or better modification versus a payline passing through two or more non-overlapping symbol locations in different areas of influence. For example, in FIG. 7C, a payline passing through symbol locations 714 and 708 (which are in two different areas of influence created by modifiers 712 and 702 respectively) may have a payout enhanced by either the modifier 702 or modifier 712 (e.g., either 2× or 3×), or may be enhanced by a sum of the modifiers 702, 712 (e.g., 5×), etc., while a payline passing through display segment 718 (which is in an overlapping area of influence created by modifiers 712 and 702) may have a larger payout enhancement by multiplying the modifiers 702, 712 (e.g., 6×). Thus, in one embodiment, a display segment(s) associated with overlapping areas of influence may increase a payout on a traversing payline in a heightened manner relative to non-overlapping areas of influence where multiple symbol locations from multiple areas of influence are traversed. In still other embodiments, no such benefit is provided for symbol locations in overlapping areas of influence, and in still other embodiments, symbol locations with overlapping areas of influence may be provided with a lesser benefit than other payouts.

On the next reel spin, FIG. 7D depicts the further migration downward on the grid 700 by modifier 702, and further migration to the right on the grid 700 by modifier 712, resulting in the modifiers 702, 712 themselves intersecting. In the illustrated embodiment of FIG. 7D, this intersection of modifiers results in creation of a collective modifier 728, which is greater than the modification that the plurality of intersecting modifiers would have otherwise provided in one embodiment. For example, in the example of FIG. 7C a payline passing through display segment 718 may provide the greater of (or alternatively lesser of) or sum of the modifiers 702, 712, where in the example of FIG. 7D, the payout from a payline passing through any of the symbol locations 720, 722, 724, 726 may be enhanced by the product of the modifiers which resulted in a unified, different modifier 728 (e.g., a 6× multiplier in this example).

In any event, modifiers that migrate across or otherwise move about a play area can intersect, and as a result provide a different type and/or amount of modification or enhancement. As an example of a different type of modification, one embodiment may change the symbols in symbol locations from intersecting modifiers, such as symbol locations 720, 722, 724, 726 of FIG. 7D, into wild symbols, higher value symbols, bonus symbols, etc., for the paylines passing through them. In other embodiments, such as the example depicted in FIG. 7D, the intersecting modifier itself changes to, for example, a different modifier. The different modifier may be a larger value of the same type (e.g., intersecting 4× and 5× multipliers provide a 20× multiplier), or may be of a different type. For example, two intersecting multipliers may provide a fixed amount of one thousand credits, or a multiplier determined by using one number as a base and the other as an exponent, or a guaranteed bonus round(s) or free spins, etc.

At the next spin depicted in FIG. 7E, the original modifiers 702, 712 continue along their respective original paths, causing the common modifier 728 to separate back into the original modifiers 702, 712. More particularly, the 2× modifier 702 continues moving downward on the grid 700, while the 3× modifier 712 continues moving to the right on the grid 700, disbanding their prior intersection. The area of influence is no longer common as was the case in FIG. 7D, but rather returns to two distinct but possibly overlapping areas of influence. FIG. 7E shows the new area of influence of modifier 702 to include symbol locations 722 and 730, while the new area of influence of modifier 712 includes symbol locations 724, 730, 732, 734. As previously described, payouts from paylines passing through any of the symbol locations impacted by an area of influence of the modifiers 702, 712 may be enhanced or otherwise modified. In one particular embodiment, symbol locations identified by overlapping portions of the areas of influence, particularly display segment 730 and FIG. 7E, may provide a larger, better, or otherwise different modification factor then the modifiers 702, 712 may have individually.

Figure 7F:
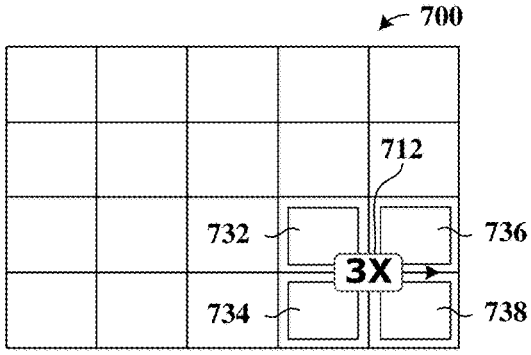

In FIG. 7F, the most recent spin caused the modifier 702 to disappear, as it had already reached an end point, which is the grid 700 border in one embodiment. Therefore, the multiplier 702 no longer has any impact on the grid 700 of FIG. 7F. However, the modifier 712 is seen having moved an additional grid location to the right, thereby creating a new area of influence involving the four symbol locations 732, 734, 736, 738 on which the modifier 712 is in contact with. Paylines passing through any of these symbol locations 732, 734, 736, 738 will therefore have their payouts modified by the modification value or other action associated with the modifier 712.

Figure 8A:
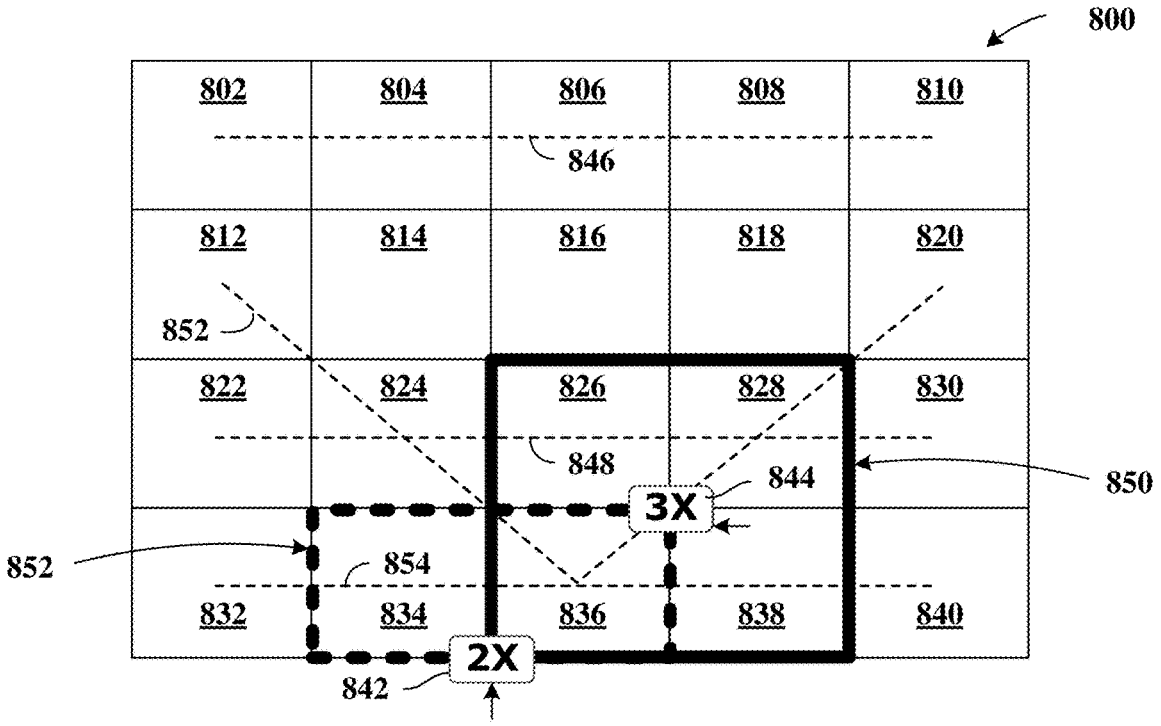
FIGS. 8A and 8B depict stages of a game where intersecting payout modifiers create a new payout modifier.
Figure 8B:
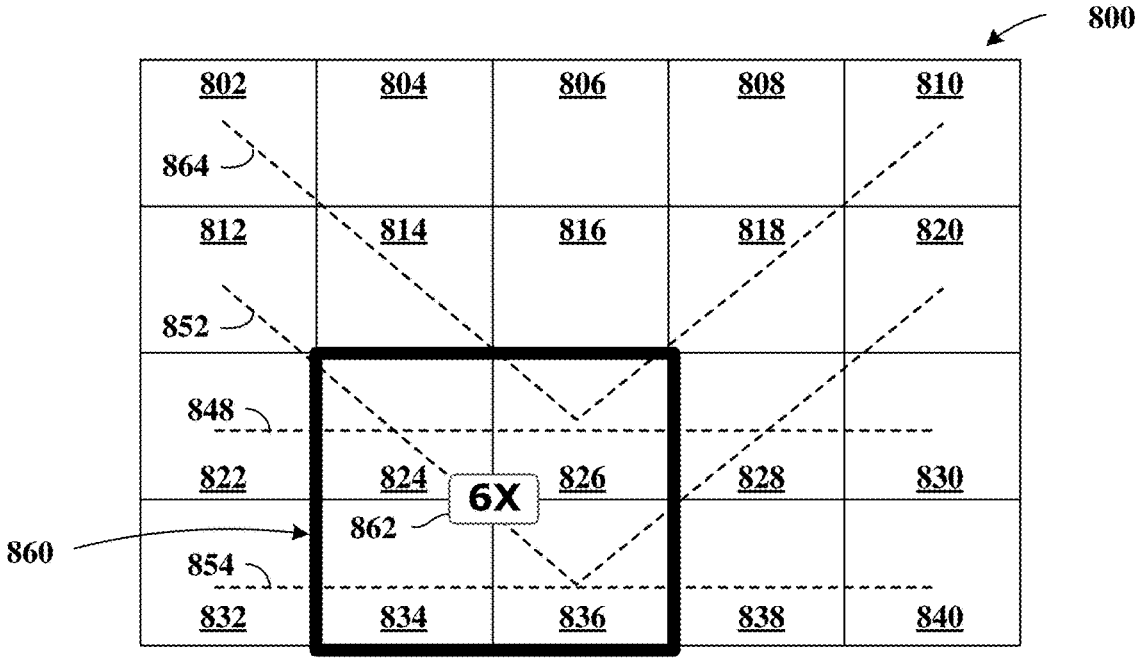

As noted above, payouts on paylines may not be modified, or may be modified in different ways, depending on the state of the migrating modifiers. FIGS. 8A and 8B provide examples of how payline payouts can be impacted. In FIG. 8A, a display grid 800 includes an array of symbol locations 802-840. Analogous to that of FIG. 7E, two modifiers 842, 844 have migrated such that they both border at least one display segment 836. Therefore, there may be some paylines with no migrating modifiers associated therewith, some paylines with one migrating modifier associated therewith, some paylines with multiple modifiers bordering it, etc.

For example, a payline 846 passing through symbol locations 802, 804, 806, 808, 810 would not have any payout enhanced or otherwise modified, as the no modifier has an area of influence that involves any of these symbol locations 802-810. A payline 848 passing through symbol locations 822, 824, 826, 828, 830 would be awarded a 3× multiplier, as the modifier 844 creates an area of influence 850 through which the payline 848 passes. A payline 852 passing through symbol locations 812, 824, 836, 828, 820 passes through the area of influence 850 resulting from the modifier 844, and passes through the area of influence 852 resulting from the modifier 842. Because display segment 828 is subject to modifier 844 and therefore a 3× multiplier, payouts on paylines 852 can be enhanced by three times. However, payline 852 also passes through display segment 836 which is bordered by both modifiers 842 and 844. In one embodiment, display segment 836 would thereby be awarded a larger modifier value, such as the sum of the bordering modifiers 842, 844 (e.g., a 5× multiplier in this example). In some embodiments, payouts on payline 852 would be awarded both the 3× multiplier and the larger 5× multiplier, where in other embodiments perhaps only the larger of the multipliers would be awarded (e.g., since payline 852 is impacted by both area of influences 850, 852, the larger is used, where the larger is the sum of the multipliers from the two modifiers 842, 844 that border display segment 836. Other criteria for how many or which ones of multiple modifiers are used to modify implicated payouts are equally possible and within the scope of the present disclosure.

Payline 854, which includes symbol locations 832, 834, 836, 838, 840, also includes symbol locations that are outside any area of influence, are inside one area of influence, and are inside multiple areas of influence. Specifically, symbol locations 832 and 840 are not within an area of influence, and without more would not provide result in modification of a payout on payline 854. Display segment 834 is within area of influence 852 resulting from modifier 842, and display segment 838 is within area of influence 850 resulting from modifier 844, which would respectively result in both modifiers 842 and 844 applying to a payout on payline 854. As noted above, either or both of the modifiers 842, 844 could be applied. However, yet another display segment, display segment 836, is positioned at overlapping sections of areas of influence 850, 852. As previously noted, this display segment in such a situation may provide the same or higher modification, such as the sum of modifiers 842, 844 (e.g., 5× multiplier). In any event, the modification to any payout on payline 854 is determined based on rules identified where multiple areas of influence 850, 852 are involved with the payline 854.

FIG. 8B depicts the display grid 800 again including the array of symbol locations 802-840. Analogous to that of FIG. 7D, two modifiers 842, 844 (FIG. 8A) are assumed to have migrated such that they intersect with one another at the same location, thereby creating a coterminous area of influence 860. In one embodiment, intersecting modifiers 842, 844 (FIG. 8A) create a larger or otherwise further enhanced modifier 862. Such further enhancement may be the result of a mathematical operation of the intersecting modifiers, such as multiplying the multiplier values (e.g., a multiplier of 3 times a multiplier of 2 equals a multiplier of 6), or using exponents (e.g., a multiplier of 3 to the power of 2 equals a multiplier of 9), etc. In such embodiments, any payline that passes through the area of influence 860 will receive the new modifier 862. Particularly, in the example of FIG. 8B, payouts on any of paylines 864, 852, 848 and 854 will receive a 6× enhancement as a result of the modifier 862 and associated area of influence 860.

In other embodiments, the migrating modifiers may be positioned on a slot grid or other game play area such that it is capable of bordering a fewer number of symbol locations. For example, in prior examples, a modifier was able to contact up to four (or more) symbol locations, such as by being positioned on the intersection of four symbol locations. An example of such a modifier was shown in FIG. 8B, where the 6× modifier 862 is positioned at the border of, and thereby contacting, four symbol locations 824, 826, 834, 836. In other embodiments, such as the embodiment of FIGS. 9A-9F, the modifiers are positioned on borders of one or two symbol locations, thereby having an area of influence of either one or two display segments. It should be recognized that the modifiers described herein may border as few or as many symbol locations as desired and as facilitated by the structure and layout of the play area.

Figure 9A:
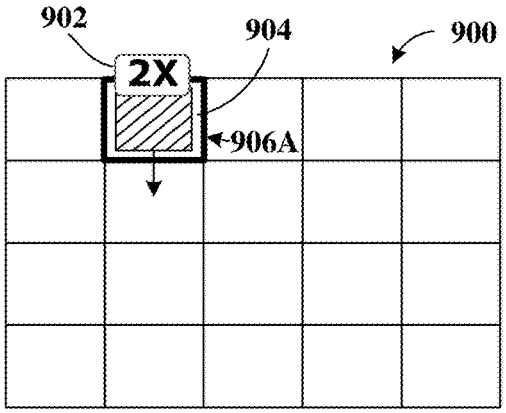
FIGS. 9A-9F depict stages of payout modifiers in a slot game, where the payout modifiers are positioned on borders of either one or two symbol locations to respectively create a one or two display segment area of influence.

FIG. 9A depicts an embodiment where modifiers are positioned on and moved to borders of only one or two symbol locations in an exemplary slot game grid 900. The multiplier 902 is positioned on a border of display segment 904, thereby creating an area of influence 906A that includes only the one display segment 904. Therefore, paylines passing through the area of influence 906A can be enhanced by the modifier 902.

At a next stage, such as after a passage of time or a new spin of the slot game, the modifier 902 moves in a particular direction, which is down the grid 900 in the illustrated embodiment. The modifier 902 now resides on a border of two symbol locations 904, 908, creating an area of influence 906B that includes these two symbol locations 904, 908. Therefore, paylines passing through the new area of influence 906B can be enhanced by the modifier 902. As shown in FIG. 9C, the modifier 902 continues moving downward on the grid 900, such as on the next reel spin, where it reaches the next border between symbol locations 908, 910 to form a new area of influence 906C. Therefore, paylines passing through the new area of influence 906C can be enhanced by the modifier 902.

Figure 9D:
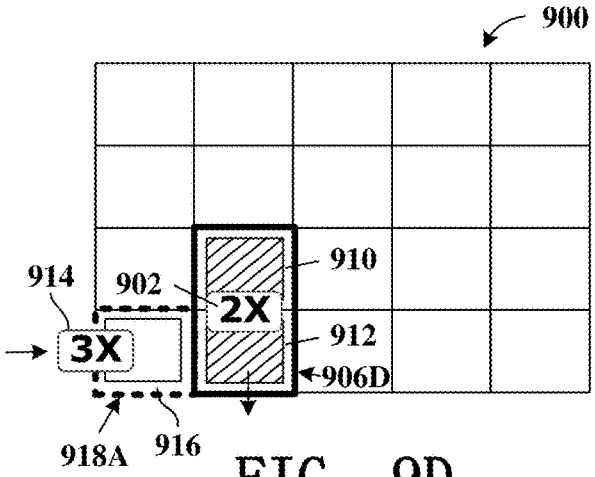
Figure 9B:
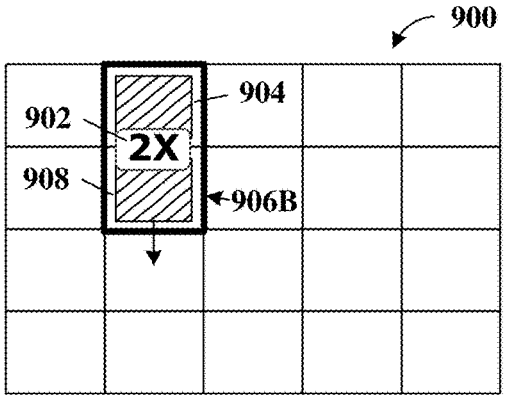

FIG. 9D depicts an embodiment where multiple modifiers are migrating on the grid 900. At the next reel spin or other stage, the modifier 902 has moved to reside on a border of two symbol locations 910, 912 forming area of influence 906D. Also, a second modifier 914 has been initiated on the left border of the grid 900 (although it could be initiated at any position on the grid 900). As the modifier 914 contacts only one display segment 916, the area of influence 918A includes only one display segment 916. Paylines passing through one or both of the areas of influence 906D, 918A may have their respective payouts enhanced or otherwise modified by the respective modifier 902, 914. For example, a payline passing through only display segment 910 would have its payout enhanced by the modifier 902. A payline passing through both symbol locations 916 and 912 can have one or both modifiers 914, 902 apply to any winning payout. For example, in the illustrated embodiment of FIG. 9D, a payline through the bottom row of symbol locations may have its payout multiplied by three and by two in view of the modifiers 914, 902. In other embodiments, other rules may apply, such as using the largest of the modifiers, or the smallest of the modifiers, or the sum of the modifiers, or the product of the modifiers, etc., when multiple areas of influence are associated with the payline.

Figure 9E:
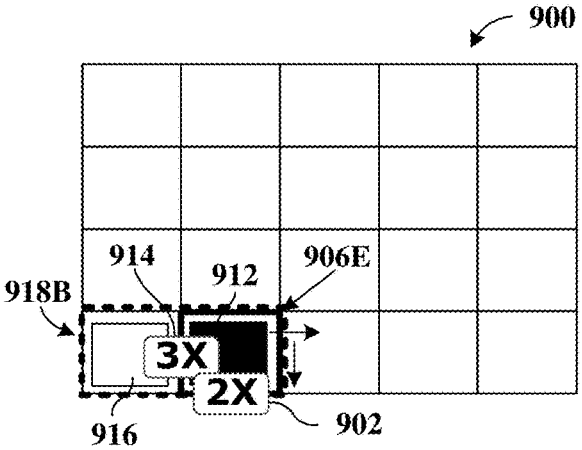
Figure 9C:
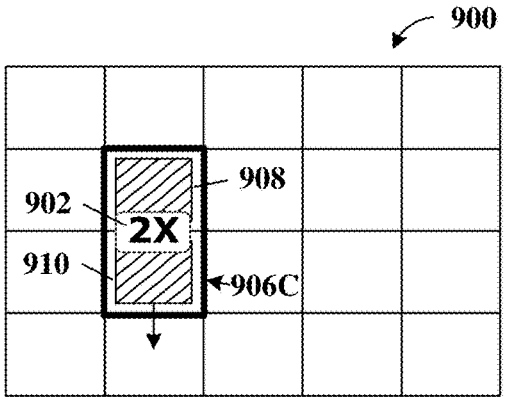

FIG. 9E depicts the next stage where the modifier 902 has again moved down the grid 900 to the next border, and the modifier 914 has moved to the right along the grid 900 to straddle symbol locations 916 and 912. Since the modifier 902 resides on the border of only one display segment 912, its area of influence 906E only includes display segment 912. On the other hand, modifier 914 resides on the border of two symbol locations 916, 912, whereby its area of influence 918B includes those two symbol locations 916, 912. In this embodiment, modifiers 902 and 914 are both on the border of display segment 912, creating an overlap, and in some embodiments a further enhanced modification function. For example, rather than the modifiers 902, 914 separately applying to any payout on a payline passing through the display segment 912, the modifiers 902, 914 may be multiplied together (e.g., forming a 6× multiplier) or otherwise utilized to create a further enhanced or at least different modification than where the modifiers 902, 914 are associated with different symbol locations along a payline.

Figure 9F:
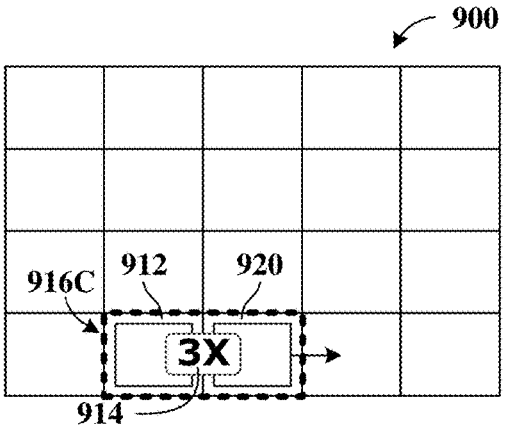

FIG. 9F depicts the next stage, such as the next spin of the slot game, whereby the modifier 902 has moved beyond the play area and is no longer in use, and the modifier 914 has again moved to the right along the grid 900. Therefore, only the modifier 914 is active, creating an area of influence 916C that includes symbol locations 912 and 920. Therefore, paylines passing through the area of influence 916C will have its payouts modified by the value or instruction provided via the modifier 914.

Figure 10A:
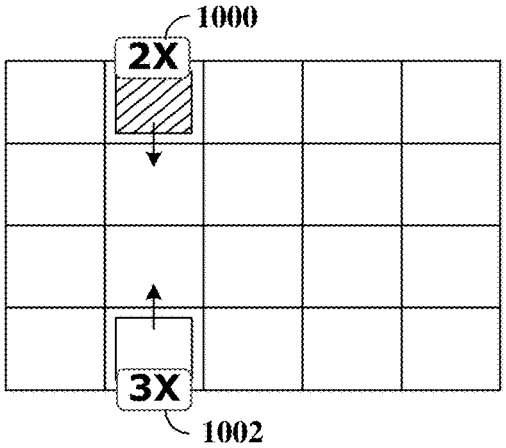
FIGS. 10A-10F depict another example where modifiers are capable of bordering two symbol locations, where the migration of the modifiers is directly towards one another.
Figure 10D:
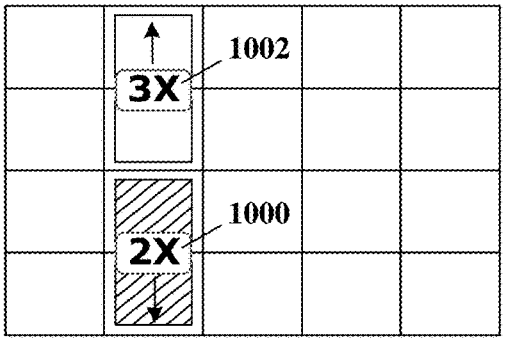
Figure 10B:
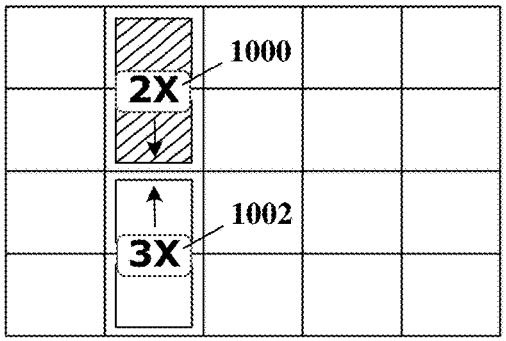
Figure 10E:
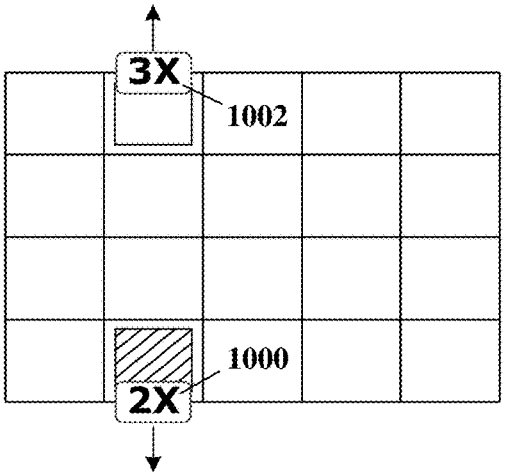
Figure 10C:
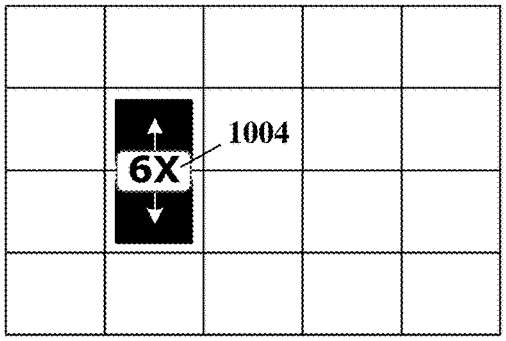
Figure 10F:
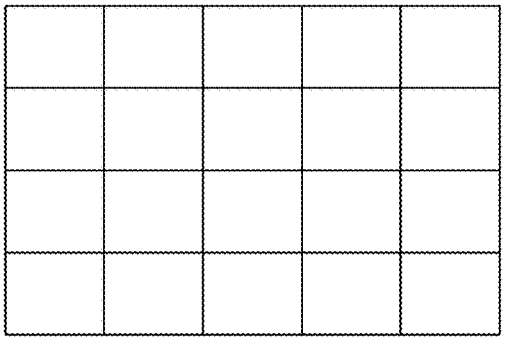

FIGS. 10A-10F depict another example where modifiers are capable of bordering two symbol locations, where the migration of the modifiers is directly towards one another. In this example, the progression of modifiers 1000, 1002 shown in FIG. 10A depict respective areas of influence that change as the respective modifier 1000, 1002 moves. When the modifiers 1000, 1002 intersect as depicted at FIG. 10C, the modifiers may transform into a different, collective modifier 1004, such as a multiplier corresponding to the product of the original intersecting multipliers. As the next spins occur, as shown at FIGS. 10D-10F, the modifiers 1000, 1002 again separate, creating new areas of influence along the way, until they ultimately "fall off" the grid where their use expires. It should be recognized that still further modifiers could originate at any location and move in any direction in addition to or instead of those depicted in FIGS. 10A-10F.

In still other embodiments, the migrating modifiers may be positioned on a slot grid or other game play area such that it is capable of enlisting a single display segment as its area of influence. In the example of FIGS. 11A-11F, the modifiers are positioned on, around, within, etc. a single display segment, thereby having an area of influence of one display segment. This embodiment works analogously to prior-described embodiments, with the exception that a modifier activates just one display segment for inclusion in payout modifications. As in prior-described embodiments, multiple modifiers may originate at any location on the grid 1100, such as on a border of the grid 1100.

Figure 11A:
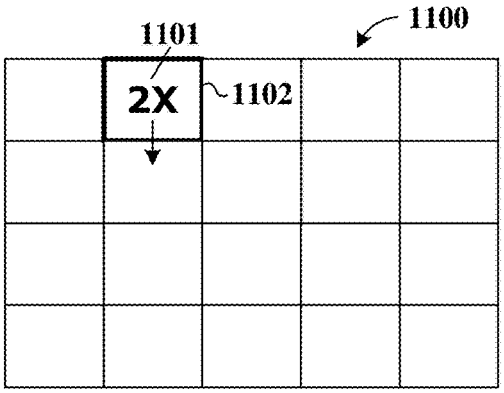
FIGS. 11A-11F depict stages of migrating modifiers capable of enlisting a single display segment as its respective single-display-segment area of influence.
Figure 11D:
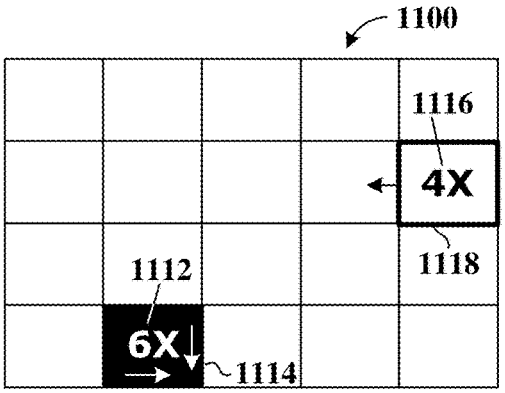
Figure 11B:
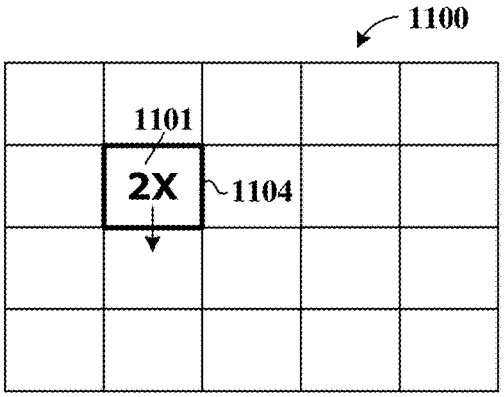
Figure 11E:
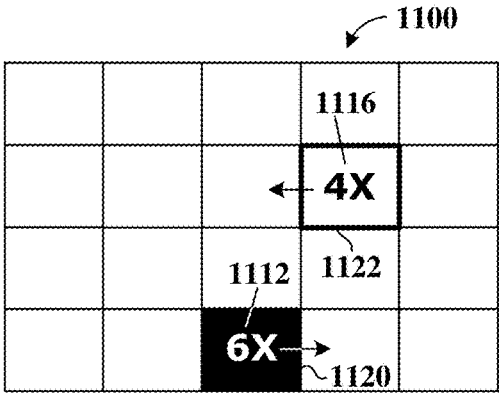
Figure 11C:
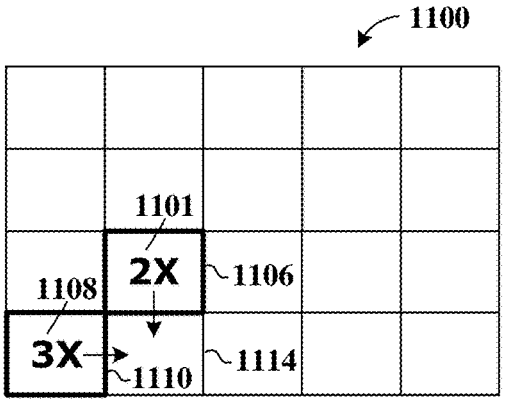

Referring first to FIG. 11A, this example involves a modifier 1101, which is a 2× multiplier in this example, originating at a first display segment 1102. Any paylines passing through display segment 1102 will therefore have its payouts multiplied by two. On the next spin or other predetermined event/time, the modifier 1101 moves to display segment 1104 as shown in FIG. 11B, and continues to move to display segment 1106 as shown in FIG. 11C. On this particular spin or other predetermined event/time, another modifier 1108 originated at display segment 1110, which in the illustrated embodiment is a 3× multiplier. Therefore, paylines passing through either or both of symbol locations 1106, 1110 may have their associated payouts enhanced or otherwise modified by the modifiers 1101, 1108.

In one embodiment, the direction of movement of multiple modifiers may cause the modifiers two intersect at a particular display segment. As depicted in FIG. 11C, the modifier 1101 is moving down the grid 1100 towards display segment 1114, and modifier 1108 is moving to the right on the grid 1100 towards display segment 1114. On the next spin depicted at FIG. 11D, the modifiers 1101 and 1108 intersect, creating a new and/or different modifier 1112, which in the illustrated embodiment is a 6× multiplier created by multiplying the values of the intersecting multipliers 1101, 1108. Paylines passing through display segment 1114 would thereby have their respective payout values multiplied by the 6× modifier 1112.

Also on this spin, another new modifier 1116 originated, this time at display segment 1118. On the subsequent spin, each of the modifiers moves in a random or predetermined fashion. In the illustrated embodiment, the modifiers 1112 and 1116 move in straight paths, such that the 4× modifier 1116 moves to the left on the grid 1100, while the 6× modifier 1112 continues to move to the right. This movement continues to occur on each subsequent spin, as further depicted by the next spin movements of modifiers 1112, 1116 in FIG. 11F.

In one embodiment, modifiers that intersect may form a new, common modifier that differs in some manner from the plurality of intersecting modifiers that created the new, common modifier. In some embodiments, on subsequent spins or other predefined events/times after such an intersection had occurred, the modifiers may return to their constituent forms—e.g., an intersection of a 2× and 3× modifier may create a 6× modifier, and on a subsequent spin the 2× and 3× modifiers may rematerialize from the 6× modifier as they travel along their original (or new) paths. An example of such an embodiment was described in connection with FIG. 7A-7F, where the modifiers 702, 712 combined into a 6× modifier 728 at FIG. 7D, and returned again to 2× modifier 702 and 3× modifier 712 on a subsequent spin shown at FIG. 7E.

Figure 11F:
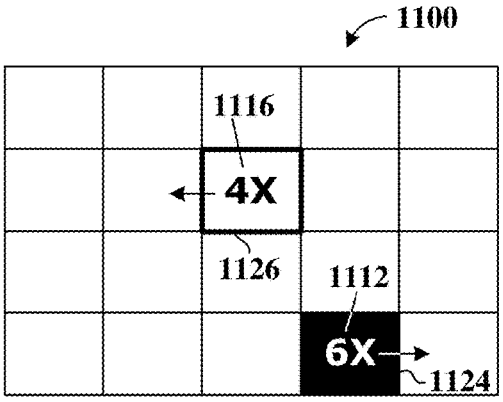

However, in other embodiments, once a plurality of modifiers have intersected to create a new modifier, that new modifier may remain in play for subsequent spins. In other words, rather than having the original modifiers separate back out from the new, common modifier, the new, common modifier may take the place of the original intersecting modifiers until that modifier is no longer active for that game. An example of such an embodiment is shown in FIGS. 11A-11F. The 2× modifier 1101 and 3× modifier 1108 (see FIG. 11C) intersect at display segment 1114 (see FIG. 11D), where a new, common 6× modifier 1112 is created. As depicted in FIGS. 11E and 11F showing subsequent spins, the 6× modifier 1112 persists, and moves in a path towards its destination. The direction in which the new, common modifier 1112 moves may be random, may continue in the direction of one of the original intersecting modifiers, may follow a pattern, etc. In the illustrated embodiment, the modifier 1112 follows the path of one of the intersecting modifiers 1108.

Figure 12A:
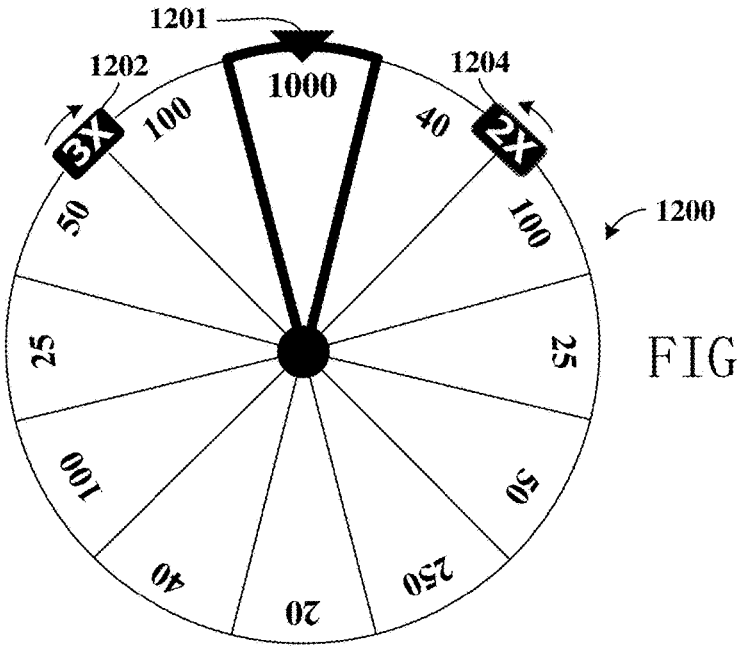
FIGS. 12A-12E depict stages of migrating modifiers used in connection with a wheel-based wagering game.

The principles described herein are applicable to a variety of games, including games of chance, such as slot games, slot bonus games, poker, roulette, bingo, etc. FIG. 12A depicts a wheel-based wagering game, where the player can obtain winnings or other benefits by physically or virtually activating a wheel or other movable shape where the winnings or other benefits are identifiable at a certain time, such as when the shape stops moving. In the example of FIG. 12A, a wheel 1200 is depicted with numerous indicia, including fixed or variable prize-winnings, free spin awards, merchandise, etc. the wheel 1200 may be a standalone game, or may be a feature of another game, such as a bonus feature of a primary slot game. One or more prize indicators 1201 may be provided to identify which area represents the relevant area in which an award may be obtained.

In this embodiment, one or more modifiers 1202, 1204 may randomly or systematically materialize on the wheel 1200, such as, for example, on the border of the wheel 1200. Generally, if the player spins the wheel 1200 and it stops on a value demarcated or otherwise indicated by a prize indicator 1201 (could be a pointer, highlighting, colors, etc.), the player may be awarded that value. In the example of FIG. 12A, the wheel has stopped on one thousand credits as noted by the adjacent prize indicator 1201. One or more modifiers, including modifier 1202 and modifier 1204 in this example (although any number of modifiers may be implemented at any given time), May materialize on the wheel 1200, and move between different values or segments on the wheel. This movement may occur in a stepwise fashion between spins, may occur continuously, may occur randomly, etc. For example, the modifiers 1202, 1204 may move during spinning of the wheel and randomly land on a spot when the wheel has stopped. In the illustrated embodiment, it is assumed that the 3× modifier 1202 is moving in a stepwise fashion in a clockwise direction on each spin of the wheel 1200, and the 2× modifier 1204 is moving in a stepwise fashion in a counterclockwise direction on each spin of the wheel 1200. In this manner, a player may see that modifiers are moving towards (or away from) the prize indicator 1201 where it can impact the total award provided.

Figure 12B:
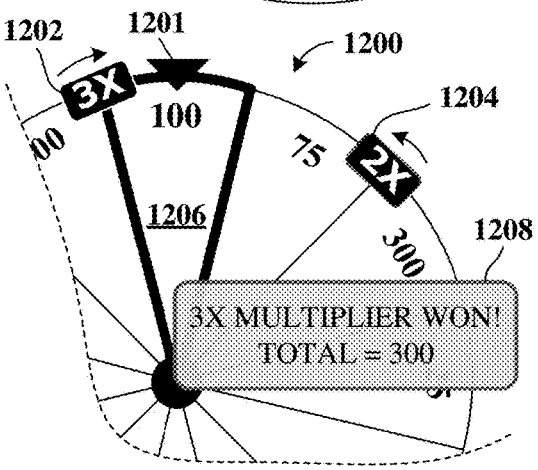

FIG. 12B depicts a subsequent state of the game, such as on a subsequent spin of the wheel 1200. At this time, the modifier 1202 has moved one border in a clockwise direction, thereby now being on a border of the wheel segment 1206 that is activated by the prize indicator 1201. The 2× modifier 1204 has also moved in its counterclockwise direction, but is not yet on the border of an active segment 1206 where a prize is identified. Therefore, the 3× modifier 1202 is available to be applied to an award at segment 1206 identified by prize indicator 1201. In this example, 100 credits was one, with the 3× modifier 1202 on its border and therefore available to triple the total winnings to 300 credits. A display 1208 or other visual, audible, tactile, and/or other notification may be provided to the player, as can be done for any of the embodiments described herein.

Figure 12D:
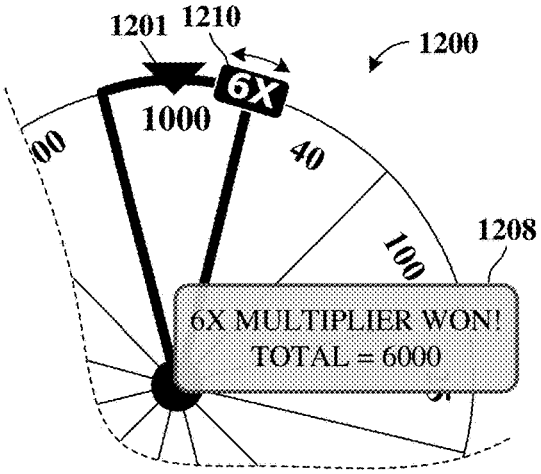
Figure 12C:
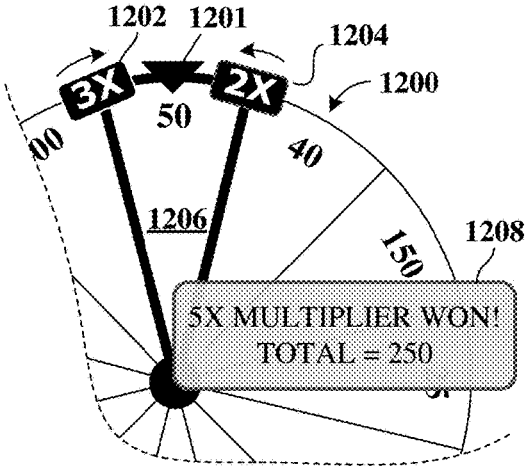

FIG. 12C depicts an alternate state of the game, such as on a spin of the wheel 1200 where multiple modifiers 1202, 1204 are on a border or otherwise activated for applying to an award identified in the active segment 1206. Therefore, both the 3× modifier 1202 and the 2× modifier 1204 may, in some embodiments, be used to enhance the award in winning wheel segment 1206. Both modifiers 1202, 1204 may be independently applied to the award at segment 1206, or some function. For example, the sum of the multiplier values of modifier 1202 and 1204 may be applied to the winning payout, which is assumed by this example where a 5× multiplier is awarded and applied to the fifty credit win for a total of 250 credits. Other embodiments may use a product of the modifiers 1202, 1204, or a quotient, etc. Any other mathematical function can also be used where multiple modifiers 1202, 1204 are at play (e.g., two times the sum of the modifiers, a fixed number such as 50× whenever multiple modifiers are at play, etc.).

FIG. 12D depicts a possible subsequent stage of the wheel play following the state of FIG. 12B. In this example, the 3× modifier 1202 of FIG. 12B continued to move clockwise one border, and the 2× modifier 1204 of FIG. 12B continued to move counterclockwise one border. In one embodiment, this results in an intersection of the two modifiers 1202, 1204, creating a new, common modifier 1210 that differs from either of the intersecting modifiers 1202, 1204. This example assumes that the intersecting modifiers 1202, 1204 are multiplied to create a product, which is a 6× modifier 1210. Therefore, whatever prize value is identified by the prize indicator 1201 will be multiplied by six. In the present example, this would result in a 6000 credit award (1000×6), which may be displayed 1208 or otherwise presented.

Figure 12E:
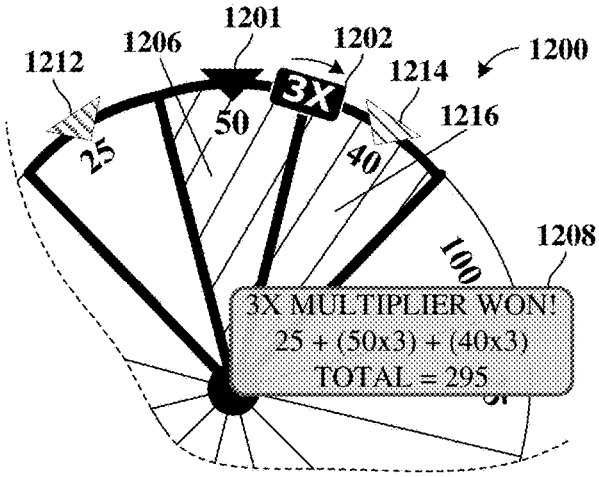

Yet another example is depicted in FIG. 12E, where the wheel or other movable game has multiple prize indicators 1201, 1212, 1214. In this example, a migrating modifier 1202 may land on a single or multiple segments 1206, 1216. The 3× modifier 1202 has positioned itself on the border of two winning segments 1206, 1216, therefore applying to both winning awards. In this example, the total award is 25 credits (from prize indicator 1212), plus 3×50 credits (from prize indicator 1201), plus 3×40 credits (from prize indicator 1214). The total award in this example would therefore be 295 credits. As can be seen, one or more modifiers 1202 may be used to enhance awards on wheels or other rotatable or movable devices.

Figure 13:
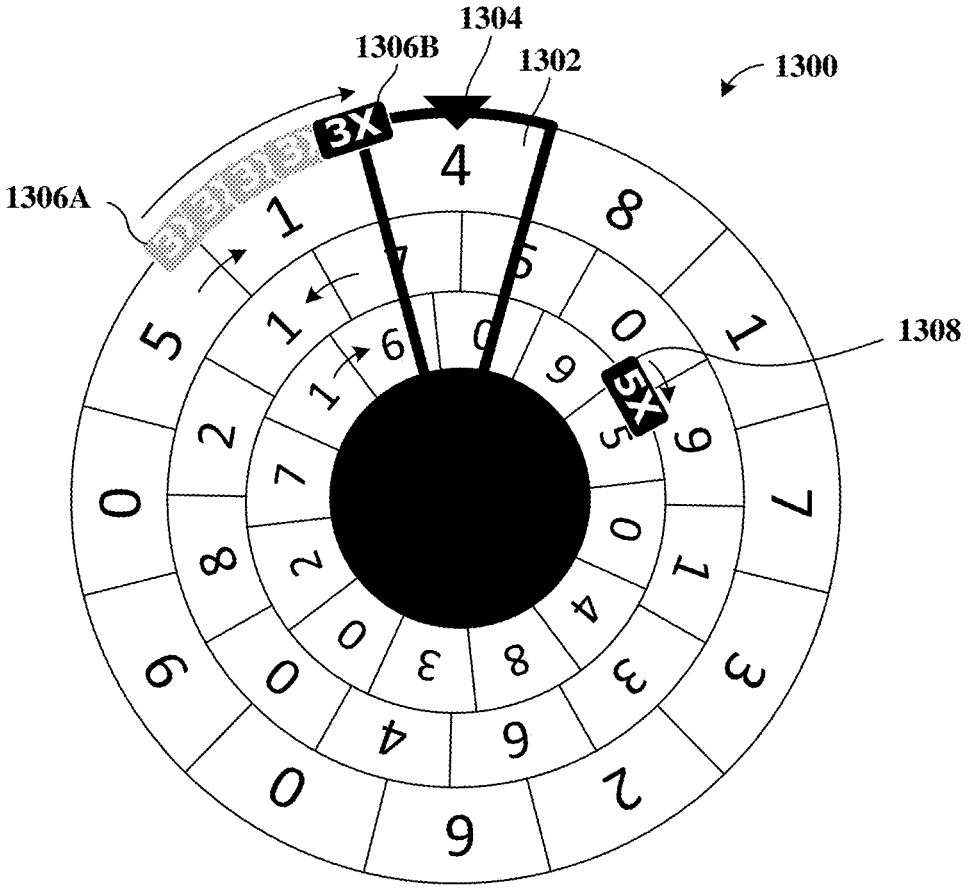
FIG. 13 depicts another embodiment of a wheel-based wagering game using migrating modifiers, where the wheel includes multiple layers (e.g., concentric circles) rotating in directions and stopping in a segment 1302 identified by a prize indicator 1304

FIG. 13 illustrates another embodiment of migrating modifiers in a wheel environment, where the wheel 1300 includes multiple layers (e.g., concentric circles) rotating in directions and stopping in a segment 1302 identified by a prize indicator 1304. In the example of FIG. 13, the innermost and outermost layers rotate in a clockwise direction, while the middle layer rotates in a counterclockwise direction (although direction is not relevant). When the wheel layers stop, the numbers or other values/indicia identified in the highlighted segment 1302 identify an award (if any). For example, if the numbers on the layers, from outermost to innermost, read 4, 5, 0, then the play would be awarded 450 units (e.g., dollars, credits, etc.). If a modifier, such as modifier 1306B and/or 1308 are positioned such that they contact the segment 1302, the modifier(s) can enhance or otherwise adjust the winning amount. As previously noted, modifiers may move, such as moving a segment on each spin. This is illustrated in FIG. 13 by the movement of the 3× modifier 1306A in a clockwise direction to the position of modifier 1306B during a spin of the wheel.

Figure 14:
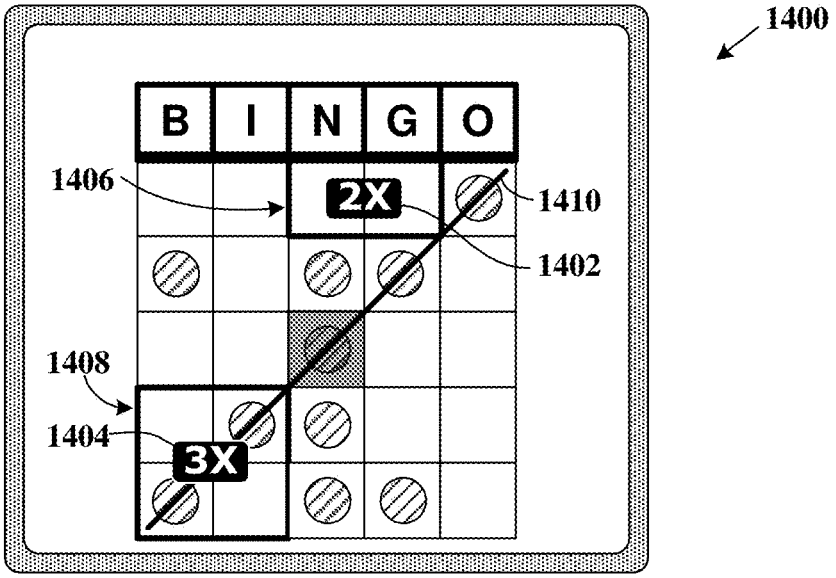
FIGS. 14 and 15A-15B illustrate yet further representative examples of games amenable to the principles described herein.

The principles described herein can be applied to any number of games, as previously indicated. FIG. 14 illustrates yet another example of a game, a bingo game 1400, in which the moving modifiers may be implemented. In the example of FIG. 14, one or more modifiers 1402, 1404 migrate along the grid, such as on each bingo turn (e.g., each called letter). Modifier 1402 creates a two-segment area of influence 1406 as it straddles two segments, while modifier 1404 creates a four-segment area of influence 1408 as it is positioned on four segments. As in other embodiments, if the modifiers 1402, 1404 intersect, a larger or otherwise more favorable modifier may be created. When a winning result occurs, i.e. a bingo occurs as depicted along line 1410, any modifiers in the bingo line will cause the bingo result to be enhanced or otherwise modified according to the value or instruction on the relevant multiplier. In this example, the bingo line 1410 passes through the area of influence 1408 of the 3× modifier 1404. Therefore, any bingo win would be multiplied by 3 to obtain the final result. For example, if winning the bingo online 1410 provided $50 (or 50 credits, etc.), the end result would be $150 (or 150 credits, etc.) based on the 3× modifier 1404.

Figure 15A:
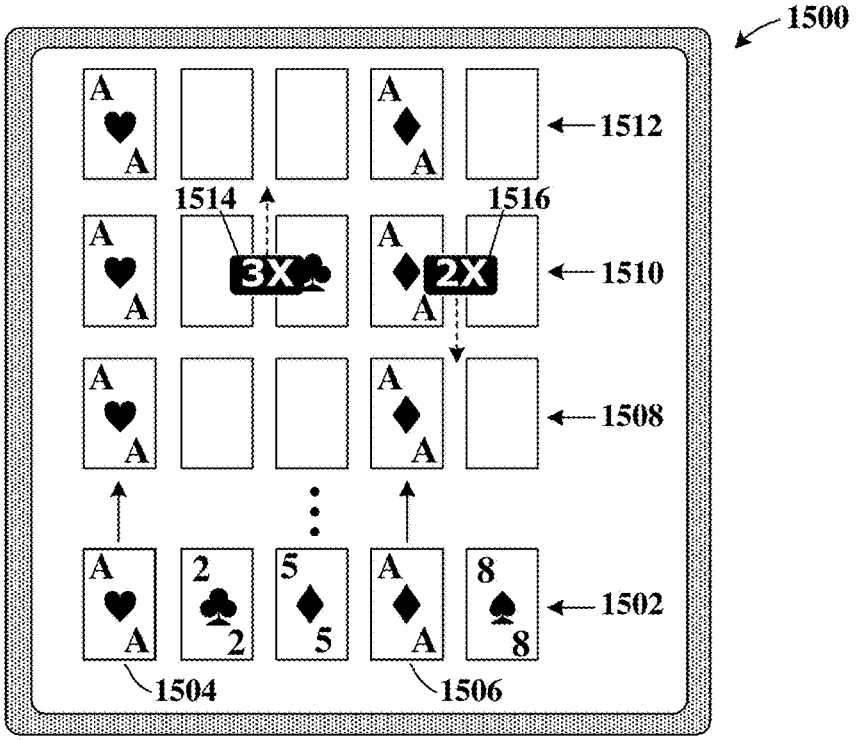

Yet another exemplary game in which the principals described herein may be applied to card games, such as the representative poker game 1500 depicted in FIG. 15A. While applicable to any poker game, the example of FIG. 15A involves a draw poker game with the ability to hold cards for replication into other hands. Primary hand 1502 is played by the player, such as optionally holding one or more cards in the primary hand 1502. In this example, the player held two aces shown at card locations 1504, 1506, which are thereby replicated into the other hands 1508, 1510, 1512.

Figure 15B:
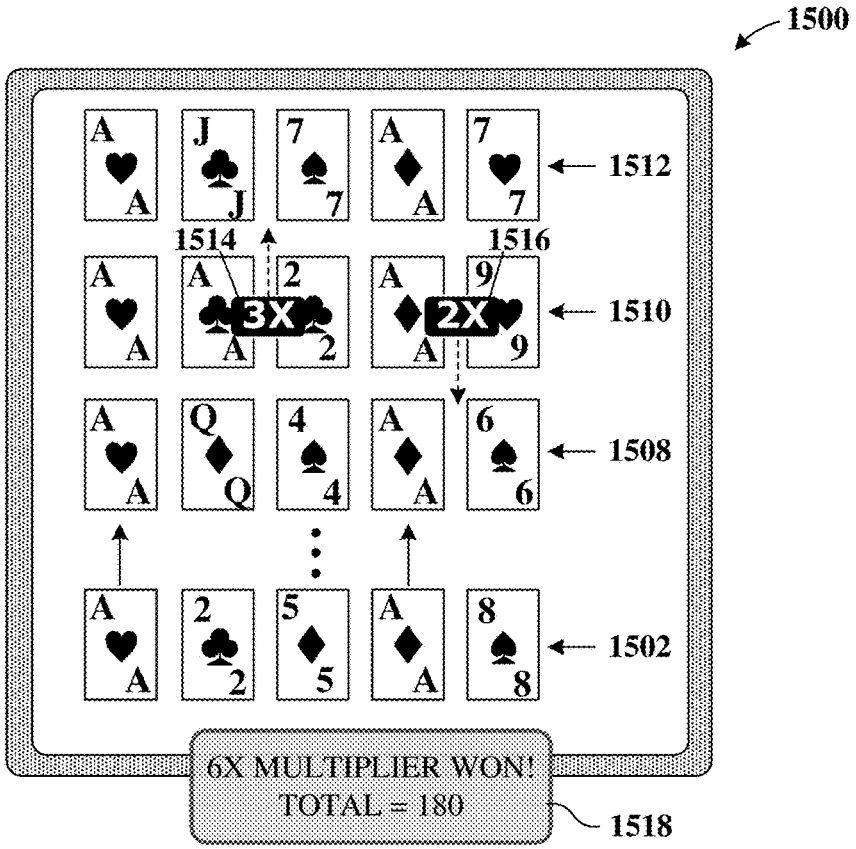

In accordance with the principles described herein, one or more modifiers 1514, 1516, may originate at some point in the array of cards, and move about the various cards in a desired manner. For example, the modifiers 1514, 1516 may move in a stepwise fashion one card in a given direction on each new deal of the game. In the present example, the 3× modifier 1514 is moving upward in the array of cards, while the 2× modifier 1516 is moving downward in the array of cards. A "payline" in this context may be a winning hand, whether the primary hand 1502 or any of the other hands 1508, 1510, 1512. If a modifier 1514, 1516 has migrated to that hand, any winning payout on that hand can be modified by the modifier(s) on that line or hand. For example, as shown in FIG. 15B, the hands 1508, 1510, 1512 have been completed with new draw cards. If the hand 1510, for example, resulted in a payout of 30 credits, the 3× modifier 1514 and 2× modifier 1516 may allow for enhancement of the payout by five times, for a total of 150 credits. As in other embodiments, where the modifiers ultimately intersect, a larger, better, or at least different modifier may temporarily or permanently take the place of the intersecting modifiers. For example, if the modifiers 1514, 1516 intersected, it may result in a 6× modifier. In another embodiment, where the modifiers 1514, 1516 land on the same hand 1510, the modifiers may be treated as if they intersected. This embodiment is depicted in FIG. 15B, where the 3× modifier 1514 and the 2× modifier 1516 have both migrated to the same hand 1510, resulting in a larger modifier where the individual modifiers are multiplied together, resulting in a 6× multiplier. The total result, depicted via the display area 1518, shows that a 30 credit win enhanced by the 6× multiplier results in a 180 credit award. In other embodiments, multiple modifiers on the same hand may provide a first level of benefit (e.g., adding multipliers from multiple modifiers), while actual intersection of the migrating modifiers may provide a second benefit (e.g., multiplying multipliers from multiple modifiers).

Figure 16:
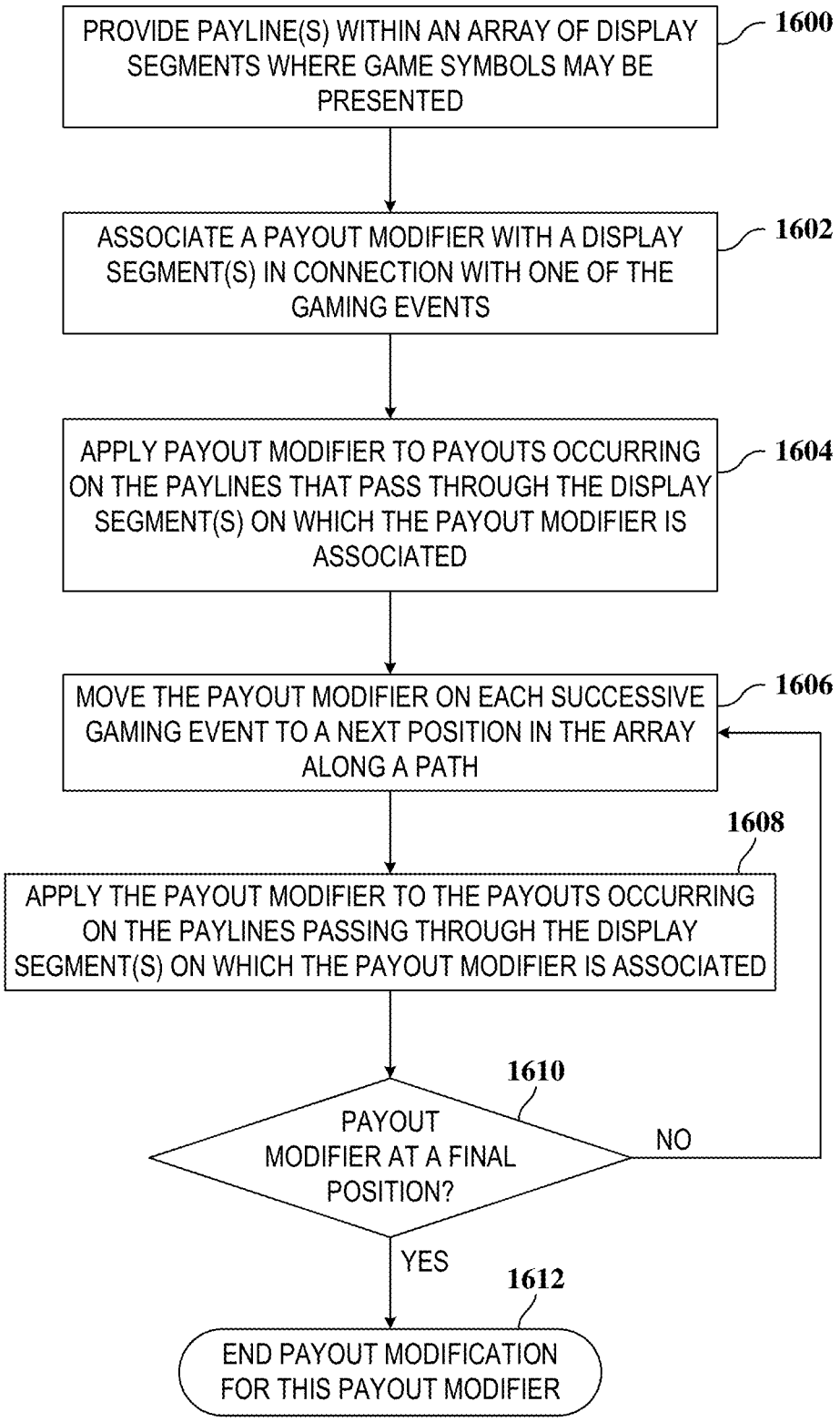
FIG. 16 is a flow diagram depicting one embodiment in which a payout modifier may move in connection with a number of gaming events.

The principles described herein are applicable to these and other gaming activities where migrating modifiers can move about the play area. As noted herein, the disclosure contemplates the use of multipliers or other payout modifiers in various manners. For example, a modifier(s) may move in connection with a series (uninterrupted or interrupted) of gaming events, such as moving based on time, moving in a stepwise fashion with each gaming event, etc. FIG. 16 is a flow diagram of one such embodiment, where at least one payout modifier moves about a play area to identify one or more display segments to modify a payout(s) on the payline(s) that include at least one of the identified display segments.

For example, referring to FIG. 16, one or more paylines are provided 1600 within an array of display segments (or within any part of a play area) where game symbols may be presented. For example, in a slot game context, some number of paylines (e.g., patterns of symbols through the display segments) may be known and stored in a gaming device, and made known to the player. A payout modifier(s) is associated 1602 with at least one display segment in connection with one of the gaming events. For example, a payout modifier may be associated with a single display segment (e.g., positioned on the display segment), associated with two display segments (e.g., positioned on a border shared by only the two display segments), associated with three or more display segments (e.g., positioned on a border or intersection of all three or more of the display segments), or the like. The payout modifier (e.g., a multiplier) is applied 1604 to payouts occurring on the paylines that pass through the display segment(s) on which the payout modifier is associated. the payout modifier may be moved 1606 over time, and/or may be moved on each successive gaming event to a next position in the array along a path. The payout modifier(s) would then be applied 1608 to those payouts occurring on the paylines that pass through the display segment(s) on which the payout modifier is associated. If the payout modifier has not yet reached a final position as determined at block 1610, the payout modifier may again be moved 1606 and applied 1608 to those display segments on which it currently is associated. This can continue until the payout modifier is at a final position as determined at block 1610, at which time the payout modification for that particular payout modifier(s) ends 1612.

Numerous variations of such a method, or apparatus performing such a method, may be included. For example, one embodiment further involves associating a second payout modifier with at least one display segment in connection with a gaming event, applying the second payout modifier to the payouts occurring on any of the paylines traversing that display segment on which the second payout modifier is associated, moving the second payout modifier on each successive gaming event to a next position in the array along a second path, and applying the second payout modifier to the payouts occurring on any of the paylines passing through the display segment(s) on which the second payout modifier is associated, until the second payout modifier has moved beyond the final position in the array along the second path. One or more additional payout modifiers may also be used, such that three, four or more payout modifiers are concurrently used, and may be moving on different paths and/or different directions on the play area.

Another embodiment of such a method further involves creating a new payout modifier if the movement of the payout modifier and the second payout modifier intersect along their respective path and second path. If more than two modifiers are in play, then an intersection of any two or more of the modifiers may create the new payout modifier(s), and the new payout modifier may have a modifier value or instruction (e.g., multiplier value) that increases depending on the number of payout modifiers that have intersected. It should be noted that "intersecting" in this fashion may mean to intersect on the same display segment (e.g., multiple modifiers could all be on the same display segment), or to intersect proximate the same display segment (e.g., multiple modifiers could be on different borders of the same display segment), or other defined manner.

In one embodiment, a new payout modifier is applied to all of the display segments associated with intersecting payout modifiers. For example, the new payout modifier created from the intersection of other modifiers may be created by multiplying values identified by the intersecting modifiers (and/or identified in other manners) to create a product value, or by adding values identified by the intersecting modifiers to create a sum value, or by using each digit individually (e.g., a 2× and 5× multiplier may create a new 25× or 52× multiplier, based on rules to position the digits such as in low-to-high order) or by applying some other mathematical function to the intersecting modifiers. A result of the mathematical cooperation of the multiple payout modifiers is applied to the payouts occurring on any of the paylines passing through the display segments on which the intersecting modifiers are associated.

These are merely representative examples of further variations of a method, or apparatus capable of performing software-based steps of such a method, as depicted in FIG. 16.

Figure 17:
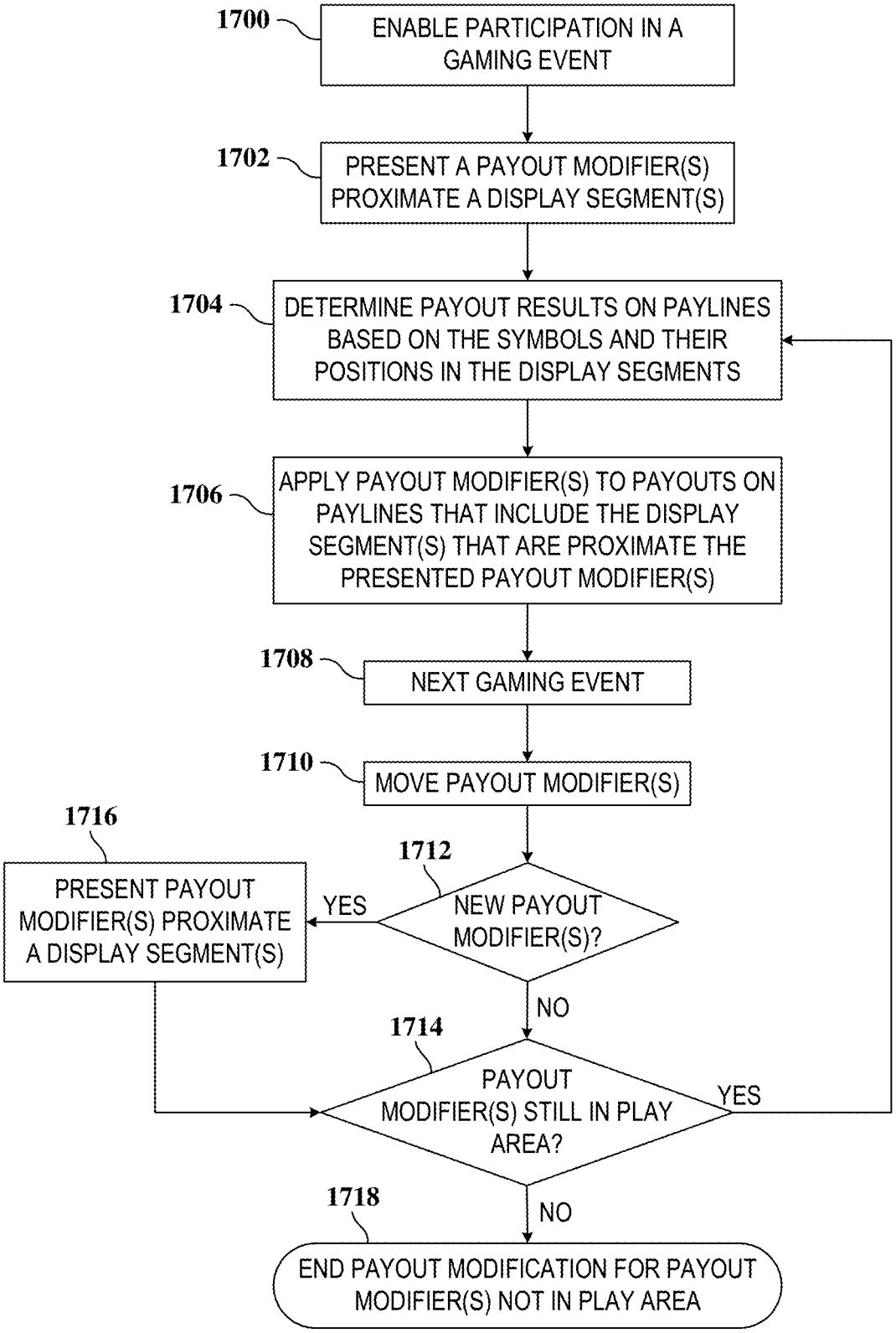
FIG. 17 is a flow diagram depicting another embodiment in which multiple payout modifiers may move in connection with a number of gaming events.

FIG. 17 is a flow diagram of an embodiment involving a payout modifier(s) that can move to new positions, where the payout modifier(s) identifies a plurality of display segments for involvement with the modification of relevant payline payouts (i.e. identifies a plurality of display segments for inclusion in the respective area of influence). The method involves enabling participation in a gaming event as depicted at block 1700, such as a slot game, poker game, bingo game, keno game, roulette game, or any other game of chance utilizing symbols, numbers, or other indicia to identify whether the participant has been awarded a payout.

In the embodiment of FIG. 17, a payout modifier is presented 1702 proximate a display segment. Multiple payout modifiers may be presented at different starting points, or even at the same starting point and move in different (or the same) directions. Being positioned "proximate" the display segment involves presenting the payout modifier(s) such that one can determine which display segment or display segments the modifier is associated with. Payout results are determined 1704 for paylines, based on the symbols and their positions in the display segments. The payout modifier(s) is applied 1706 to payouts on paylines that include the display segment(s) that are proximate the presented payout modifier(s).

In a further embodiment of FIG. 17, the participant may participate in the next gaming event 1708, such as a new spin in a slot game, a new hand in a poker game, a new spin in a roulette game, a new letter call in a bingo game, etc. In this embodiment, the payout modifier(s) move 1710 to a new position for this gaming event, such as to move 1710 one display segment forward along a path (the path may or may not be known to the participant as the modifiers move). Ultimately, if the payout modifier(s) is still in the play area as determined at block 1714, the process continues to determine 1704 the standard payout results, and to apply 1706 the moved payout modifier(s) to the payouts on paylines impacting the display segments associated with the payout modifier(s). This can continue as long as the player continues to the next gaming event 1708.

In one embodiment of FIG. 17, one or more additional payout modifiers may be presented. If a new payout modifier(s) has been presented as depicted at block 1712, this new payout modifier(s) is presented 1716 proximate one or more display segments to enable further paylines an opportunity to have their payouts modified by the new payout modifier(s). When any of the payout modifiers is no longer in the play area as determined at block 1714, the payout modification for the respective one(s) of the payout modifier(s) ends 1718.

Figure 18:
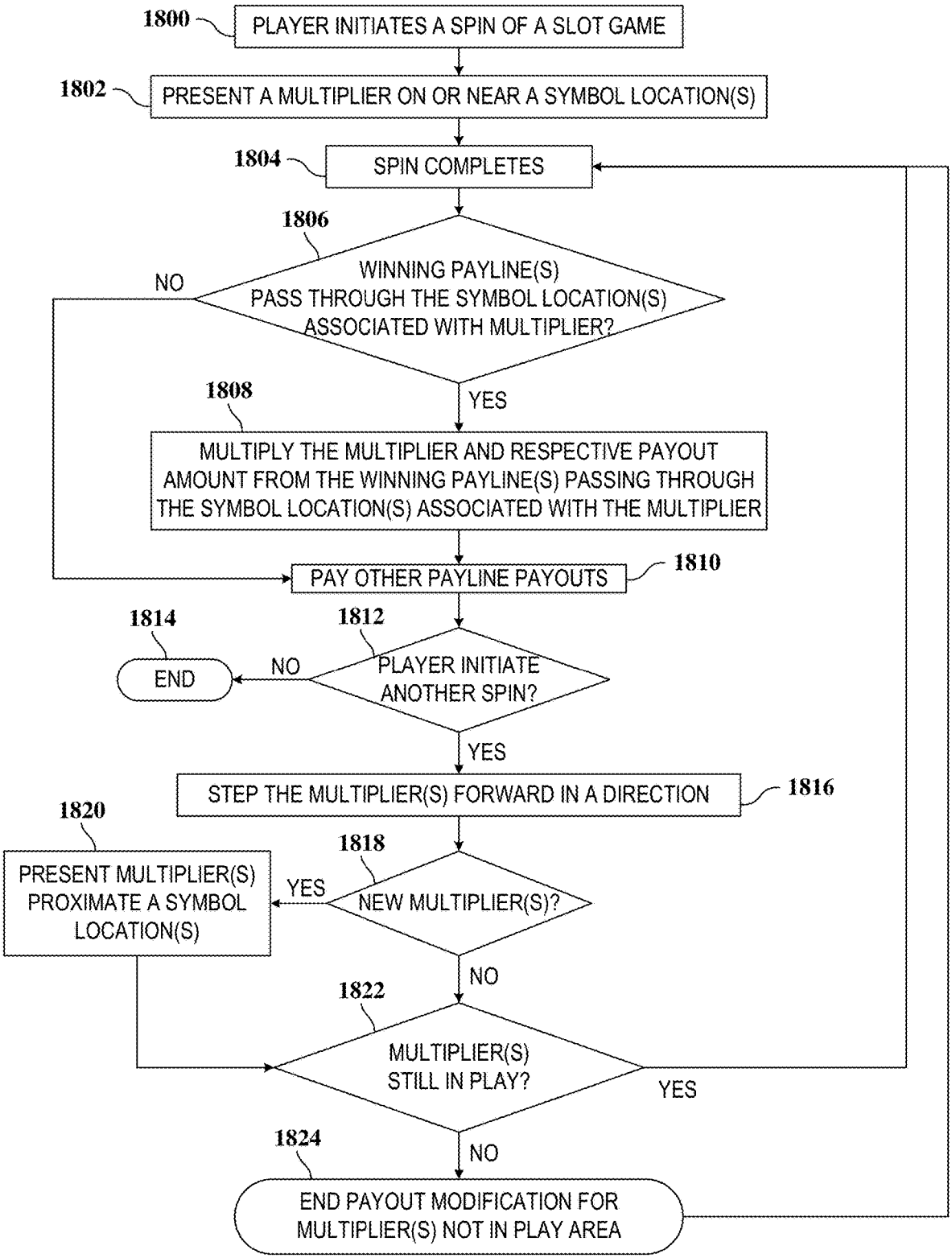
FIG. 18 is a flow diagram depicting still another embodiment in the context of a slot game, where multiple multipliers may be independently initiated and advanced in connection with a succession of slot game spins.

FIG. 18 is a flow diagram of an embodiment where the game is a slot game, and the payout modifier(s) is a multiplier. This embodiment involves one or more multipliers that can move to new positions, where the multiplier's position identifies a plurality of display segments for involvement with the enhancement of relevant payline payouts. The method involves enabling participation in a gaming event, where the player initiates 1800 a spin of a slot game. A multiplier is presented 1802 on or near a symbol location(s), such as on a symbol location, on a border or intersection of a plurality of symbol locations, etc. A spin of the "reels" completes 1804. If any winning paylines pass through the symbol location(s) associated with the multiplier as determined at block 1806, the multiplier and respective payout amount from the winning payline(s) passing through the symbol location(s) associated with the multiplier are multiplied 1808. Any other payline payouts may also be paid 1810, such as the standard payouts not associated with the payout modifiers described herein.

In one embodiment, if the player initiates 1812 another spin, the multiplier(s) in play steps forward in a direction as depicted at block 1816. one or more additional payout modifiers may be presented. If a new payout modifier(s) has been presented as depicted at block 1818, this new payout modifier(s) is presented 1820 proximate one or more symbol locations to enable further paylines an opportunity to have their payouts modified by the new multiplier(s). When any of the multipliers is no longer in the play area as determined at block 1822, the payout modification for the respective one(s) of the multiplier(s) ends 1824. If one or more multipliers are still in play, a new spin can be initiated, and completed 1804 to assess new payouts and multiplier enhancements.

Using such methods, apparatuses such as gaming devices can be developed. For example, one such gaming device includes at least a display, a user interface, and a processor (which can be a single processor, multi-chip processor, or any device(s) capable of being programmed to perform desired actions). In this embodiment, the display presents an array of display segments, each capable of presenting game symbols on a plurality of paylines for each of a plurality of gaming events. The user interface is configured to receive input to at least initiate the gaming events. The processor is configured, by way of programming code for example, to associate a payout modifier with at least one display segment in connection with one of the gaming events, apply the payout modifier to payouts occurring on any of the paylines traversing the at least one display segment on which the payout modifier is associated, move the payout modifier on successive gaming events to next positions in the array along a path, and apply the payout modifier to the payouts occurring on any of the paylines passing through at least one display segment where the payout modifier has moved, until the payout modifier has moved beyond a final position in the array along the path.

Other embodiments of such an apparatus includes the processor being configured to associate the payout modifier with two of the display segments, where the display presents the payout modifier on a shared border of the two display segments. In another embodiment, the processor is configured to associate the payout modifier with four of the display segments, where the display presents the payout modifier on a shared intersection of the four display segments. In another embodiment, the processor is configured to associate the payout modifier with one of the display segments, where the display presents the payout modifier on the display segment to which the payout modifier is associated. In yet another embodiment, the processor is configured to associate the payout modifier with two of the display segments when the payout modifier is positioned on a border of the array and configured to associate the payout modifier with four of the display segments when the payout modifier is positioned on an internal intersection of the array. In another embodiment, the processor is configured to associate the payout modifier with one of the display segments when the payout modifier is positioned on a border of the array, and is configured to associate the payout modifier with two of the display segments when the payout modifier is positioned on an internal intersection of the array. In another embodiment, the processor is configured to move the payout modifier on successive gaming events to next positions in the array along a straight path beginning on a first external border of the array and ending on the final position on a second, opposite external border of the array. Paths may alternatively be non-linear, have one or more turns, and/or be randomly positioned until reaching a final location. In another embodiment, the processor is configured to apply the payout modifier to payouts occurring on the paylines traversing more than one of the display segments on which the payout modifier is associated.

In another alternative embodiment, the processor is configured to associate the payout modifier with a first set of multiple display segments in connection with one of the gaming events, to apply the payout modifier to the payouts occurring on any of the paylines traversing at least one of the multiple display segments on which the payout modifier is associated, to move the payout modifier on successive gaming events to associate the moved payout modifier with respective subsequent sets of multiple display segments in next positions in the array along the path, and to apply the payout modifier to the payouts occurring on any of the paylines passing through at least one of the multiple display segments where the payout modifier has moved, until the payout modifier has moved beyond a final position in the array along the path.

Another representative embodiment of a gaming device includes a display presenting an array of display segments, each capable of presenting game symbols for each of a plurality of gaming events, and a user interface configured to receive input to initiate the gaming events. A processor is configured to award a payout modifier at a first location in the array proximate at least a first display segment, identify winning patterns of the game symbols on paylines in the array that pass through the first display segment, modify payouts on the paylines that pass through the first display segment using the payout modifier, move the payout modifier to a second location proximate at least a second one of the display segments for a successive one of the gaming events, identify the winning patterns of the game symbols on the paylines that pass through the second display segment, and modify the payouts on the paylines that pass through the second display segment using the payout modifier.

Another exemplary method is now described for enhancing payouts in games played by way of discrete gaming events that present symbols in a plurality of display segments. The method includes facilitating participation in a first gaming event, presenting a payout modifier at a first location proximate at least a first display segment, and determining payout results on paylines based on occurrences of the symbols in the display segments. Any of the paylines with winning payout results that traverse the first display segment are identified, and the payout modifier is applied to the winning payout results that traverse the display segment(s). The method further includes facilitating participation in a second gaming event, such as an immediately succeeding or later gaming event. The payout modifier is moved from the first location to a second location proximate at least a second one of the display segments. The payout results are determined on paylines based on occurrences of the symbols in the display segments. Any of the paylines with winning payout results that traverse the second display segment are identified, and the payout modifier is applied to the winning payout results that traverse the at least second one of the display segments. In one particular embodiment, presenting a payout modifier at the first location involves presenting the payout modifier at the first location proximate at least two of the display segments, and where moving the payout modifier involves moving the payout modifier from the first location to the second location proximate at least two of the display segments (which could be at least two entirely new display segments, or where only one or more of the display segments after movement of the payout modifier are different from the prior location).

Figure 19:
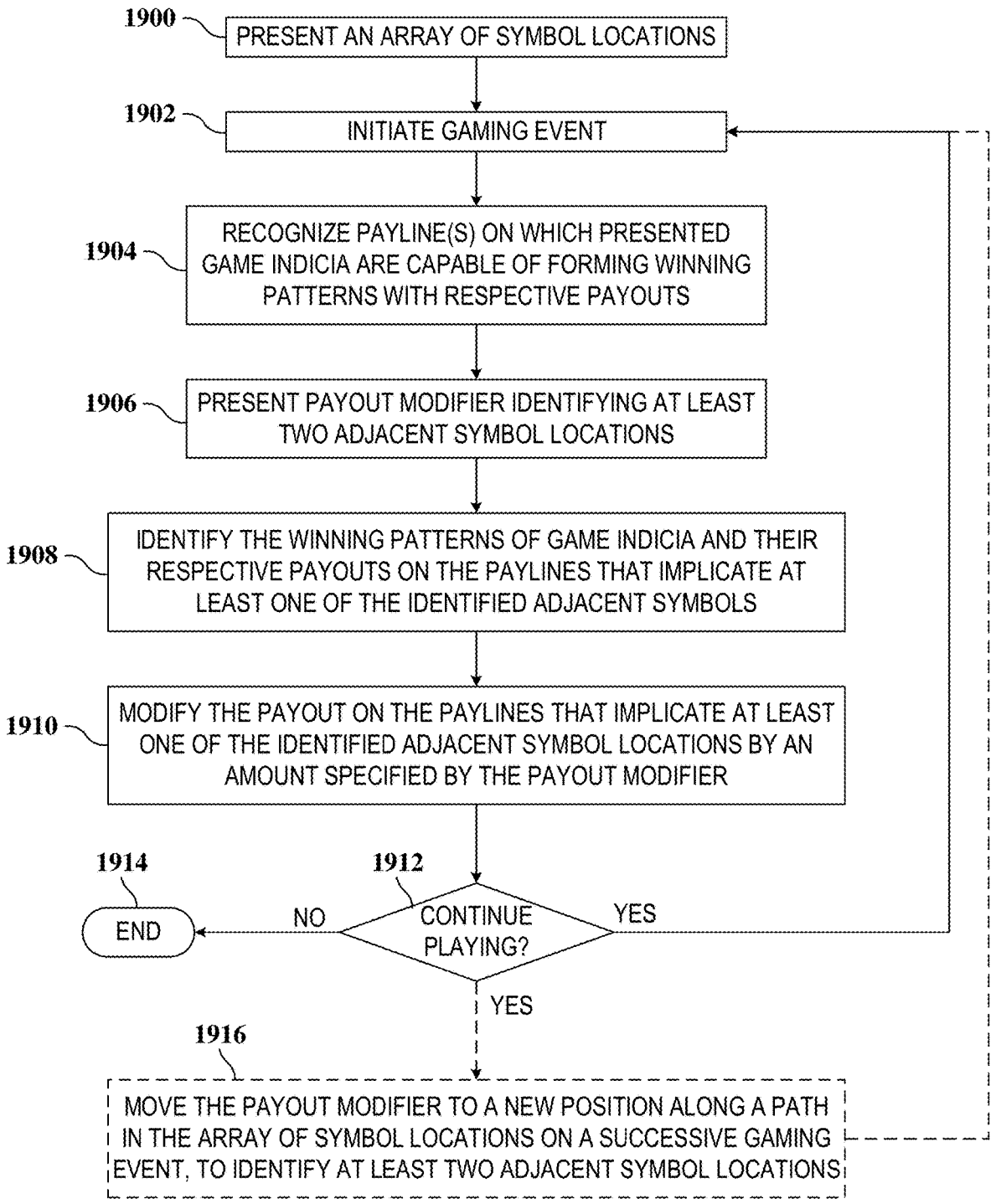
FIG. 19 is a flow diagram depicting an embodiment in which a payout modifier implicates multiple display segments when positioned, and optionally moves the payout modifier to new positions along a path on the play area.

The principles described herein are applicable to still other gaming activities where a given payout modifier implicates more than one display segment, whereby a greater area is available for a payline to pass through, which increases the chances of payout enhancement. FIG. 19 is a flow diagram illustrating a representative example of such a method, or an apparatus programmed to perform such a method. In such an example, a modifier (e.g., multiplier) may straddle the border of multiple game segments (e.g., display elements) to increase an area of influence, where payouts on paylines that pass through the area of influence are modified with the modifier.

Particularly, in the embodiment of FIG. 19, an array of symbol locations is presented 1900, such as a slot game grid. A gaming event is initiated 1902. The system recognizes paylines on which presented game indicia are capable of forming winning patterns with respective payouts (e.g., a processor accessing a stored pay table). At least one payout modifier that identifies at least two adjacent symbol locations is presented 1906. For example, the payout modifier, such as a visual multiplier value, may be positioned on the border of at least two symbol locations, thereby implicating or otherwise activating those two or more symbol locations for involvement in the payout modification methodology. Alternatively, other indications may "point" to or otherwise designate the relevant symbol locations.

The winning patterns of game indicia, and their respective payouts on the paylines that implicate at least one of the identified adjacent symbols, are identified 1908. Those payouts are then modified 1910 by an amount specified by the payout modifier. The player may choose 1912 to continue playing, and if so the game may return to initiating 1902 another gaming event, such as again spinning the reels in a slot game. Else, the game ends 1914.

In one particular embodiment, the payout modifiers may move to new positions on the play area, as previously described. In the example of FIG. 19, the payout modifier moves 1916 to a new position along a path in the array of symbol locations on a successive gaming event, to identify at least two adjacent symbol locations. Upon moving the payout modifier in this fashion, the game may return to initiating 1902 another gaming event.

Another representative embodiment for activating more than one display segment with a payout modifier include a method that includes displaying an array of symbol locations that are each capable of presenting game indicia, such as slot game symbols, for each of the gaming events (e.g., slot game spins) of the game. The gaming event is initiated by a player via a user interface. Paylines on which symbol patterns can form winning payouts are stored. A payout modifier is displayed in a position contacting at least two adjacent symbol locations, such as proximate a border of two or more symbol locations, proximate an intersection of two or more symbol locations, etc. The winning patterns of symbols and their respective payouts are determined, and those payouts on paylines that implicate the identified adjacent symbol locations are identified. The payout on those paylines that implicate the identified adjacent symbol locations are modified by an amount specified by or otherwise associated with the respective payout modifier.

Yet another representative embodiment includes a gaming device that includes at least a display, a user interface, and a processor. The display presents an array of display segments, each capable of presenting game symbols on paylines for each gaming event. The user interface is configured to receive input to initiate the gaming events of the game. The processor is configured to recognize a plurality of paylines on which the presented symbols are capable of forming winning patterns with respective payouts, to present a payout modifier identifying at least two adjacent symbol locations, to determine the winning patterns of symbols and the respective payouts on the paylines that implicate at least one of the identified adjacent symbol locations, and to modify the payout on the paylines that implicate at least one of the identified adjacent symbol locations by an amount specified by the payout modifier.

A variation of such a gaming device involves the processor being further configured to move the payout modifier to a new position along a path in the array of symbol locations on a successive one of the gaming events, to identify at least two adjacent ones of the symbol locations.

In another embodiment, the processor in such a gaming device is configured to present one or more additional payout modifiers respectively identifying at least two adjacent symbol locations, to modify the payout on the paylines that implicate at least one of the identified adjacent symbol locations by an amount specified by the respective additional payout modifier, and to move each of the payout modifier and any additional payout modifiers in respective paths on each successive gaming event. Another embodiment involves further configuring the processor to create a new payout modifier if the payout modifier and the additional payout modifiers intersect as they are moved in their respective paths.

Still other representative embodiments of such a gaming device include the processor presenting the payout modifier as a multiplier value on a border of two adjacent symbol locations, and to increase the payout on the paylines that implicate at least one of the two adjacent symbol locations by the multiplier value. Analogously, the processor may be configured to present the payout modifier as a multiplier value on an intersection of three or more symbol locations, such as four adjacent symbol locations, and to increase the payout on the paylines that implicate at least one of the four adjacent symbol locations by the multiplier value. Multiple payout modifiers may be implemented, such that the processor is further configured to present one or more additional payout modifiers respectively identifying at least two adjacent symbol locations, and to increase the payout on the paylines that implicate at least one of the identified adjacent symbol locations by an amount specified by the respective additional payout modifier.

Figure 20:
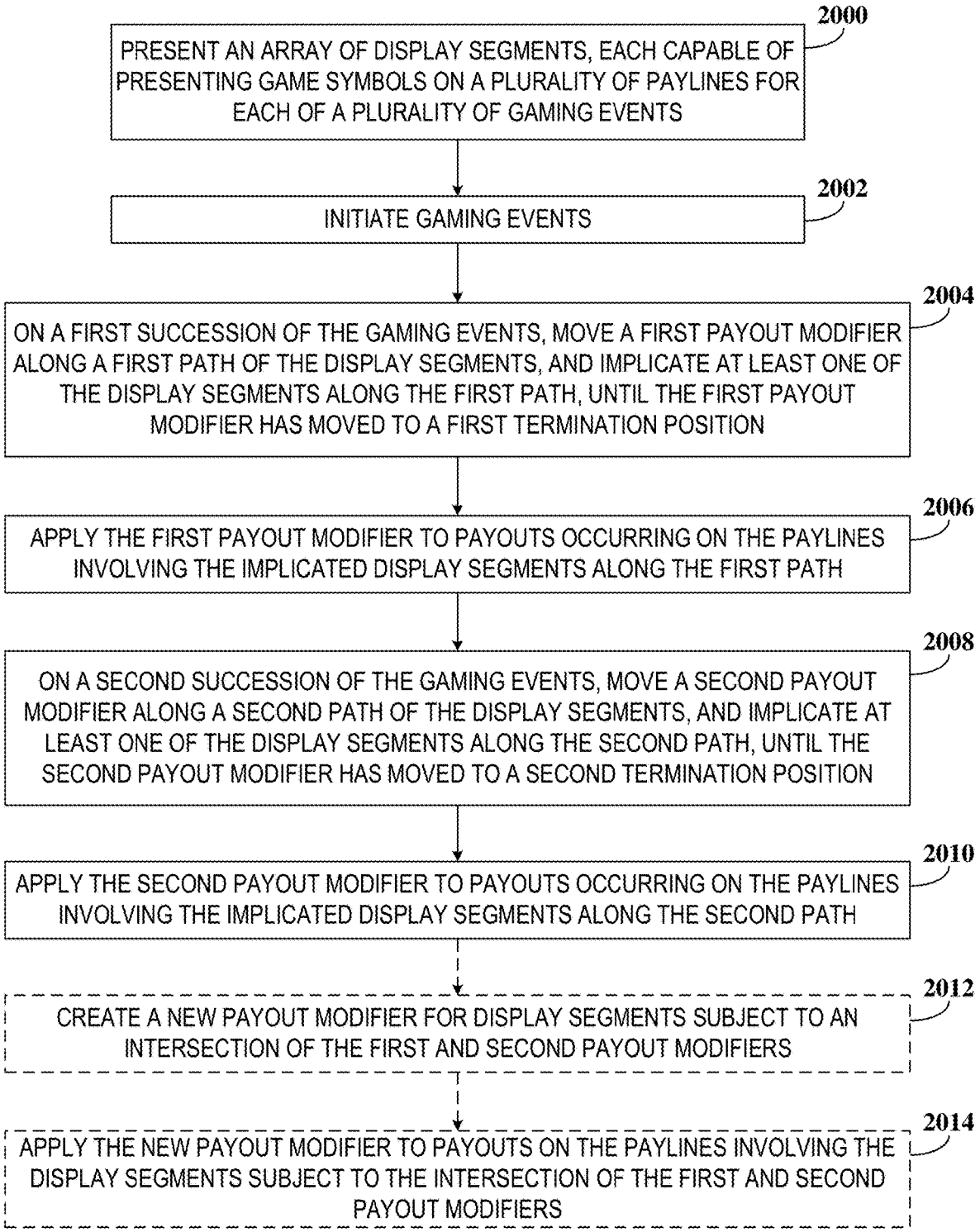
FIG. 20 is a flow diagram depicting an embodiment involving multiple payout modifiers that move independently on one another, and optionally create a new or enhanced payout modifier upon intersecting.

The principles described herein are also applicable to gaming activities where multiple payout modifiers each move about a play area with the potential for intersecting with one another to create a new or different payout modifier from the multiple payout modifiers that intersect. FIG. 20 is a flow diagram of a representative apparatus or method for utilizing a plurality of payout modifiers, and optionally providing a new payout modifier that differs from the constituent payout modifiers that intersect to create the new payout modifier. An array of display segments is presented 2000, where each of the display segments associated with this feature are capable of presenting game symbols on multiple paylines for each gaming event played. A gaming event is initiated 2002, which may be initiated by the gaming device in response to receiving an input from a player, or automatically when an automatic play feature is enabled.

The method of FIG. 20 contemplates utilizing a plurality of payout modifiers, each of which can be randomly initiated on any gaming event, in one embodiment. Thus, multiple payout modifiers may be initiated in connection with the same gaming event, or may be initiated in connection with different gaming events. Since one embodiment involves payout modifiers being utilized over multiple gaming events (e.g., moving from display segment to display segment until reaching a final location), there may be overlap in active payout modifiers. In FIG. 20, block 2004 indicates that on a first succession of the gaming events, a first payout modifier may be moved along a first path of display segments, and at least one of the display segments along the first path is implicated, until the first payout modifier has moved to a first termination position (may be randomly determined so that it simply deactivates, may be a particular location or one of a plurality of particular locations on the grid, may be a grid border position, etc.). The first payout modifier is then applied 2006 to payouts occurring on the paylines involving the implicated display segments along the first path (again, until the first payout modifier is no longer active).

At block 2008, on a second succession of the gaming events (which may or may not overlap with the first succession of gaming events), a second payout modifier may be moved along a second path of display segments, and at least one of the display segments along the second path is implicated, until the second payout modifier has moved to a second termination position (may be randomly determined so that it simply deactivates, may be a particular location or one of a plurality of particular locations on the grid, may be a grid border position, etc.). The second payout modifier is then applied 2010 to payouts occurring on the paylines involving the implicated display segments along the second path (again, until the second payout modifier is no longer active).

In one embodiment, an intersection of multiple active payout modifiers may occur, and a benefit is made available in such situations, such as a heightened or enhanced payout modifier for paylines passing through display segments affected by an intersecting plurality of payout modifiers. For example, a new payout modifier may be created 2012 for display segments subject to an intersection of the first and second payout modifiers, and the new payout modifier is applied 2014 to payouts on the paylines involving the display segments subject to the intersection of the first and second payout modifiers. In some embodiments, the new payout modifier remains in its "new payout modifier" state and may move itself about the play area, while in other embodiments the continued movement of the constituent payout modifiers cause the constituent payout modifiers to revert to their respective original states when the movement causes them to separate from the intersection.

As noted above, the first succession and second succession of gaming events may be the same succession of gaming events, or they may overlap where one payout modifier begins before the other, but at some point both are in play, or may be at different times where there is no overlap. This applies equally if there are a greater number of payout modifiers, such as a third, fourth, etc.

In various embodiments, the new payout modifier that may be created as a result of an intersection (as used herein, including a predetermined or randomly defined common point such as a display segment, whether or not the payout modifiers physically "intersect") may be augmented in different ways. the new payout modifier may change each of the constituent payout modifiers into different payout modifiers, such as 2× and 3× payout modifiers being converted to 3× and 4× payout modifiers or other enhancement. In another embodiment, the intersection of two or more payout modifiers may create/initiate still additional payout modifiers on the grid, either immediately or at some future time. In other embodiments, the new payout modifier(s) is created to have a modification function that is the same or better, for purposes of return on wagering investment, than would occur if the constituent payout modifiers were applied. For example, in one embodiment, the new payout modifier is created as a mathematical function of at least the first and second payout modifiers. In another embodiment, the first and second payout modifiers include first and second multipliers respectively, where the new payout modifier is a sum, or a product, or an exponential function, or other function of the first and second multipliers. In the case of three (or more) constituent payout modifiers, they again can be added, multiplied, any subset added, multiplied, etc. In one embodiment, the new payout modifier is positioned on an adjoining boundary of multiple display segments to create an area of influence, and is then applied to payouts occurring on the paylines where the payline passes through any of that area of influence.

For any embodiment described herein, the value of the new payout modifier may also be influenced by other factors, such as amount of wager placed, whether the maximum wager was placed, characteristics of the modifiers themselves (e.g., color, size, value, position, etc.). Thus, rules may be provided to determine the state of the new payout modifier based on any desired inputs, characteristics, etc.

In one embodiment, the first payout modifier is positioned on a first border of the display segments along the first path for each of the gaming events of the first succession, and a plurality of the display segments along the first path that share the first border are implicated for payline payout modification. In a further embodiment, the second payout modifier is positioned on a second border of the display segments along the second path for each of the gaming events of the second succession, and a plurality of the display segments along the second path that share the second border are implicated for payline payout modification. This can continue for further payout modifiers, where an $n^{th}$ payout modifier is moved along an nth path of the display segments on an $n^{th}$ succession of the gaming events, and at least one of the display segments along the $n^{th}$ path is implicated until the $n^{th}$ payout modifier has moved to an $n^{th}$ termination position. The $n^{th}$ payout modifier would be applied to payouts occurring on the paylines involving the implicated display segments along the $n^{th}$ path.

In still other embodiments, the first payout modifier is positioned on a first intersection of three or more display segments along the first path for each of the gaming events of the first succession, and the three or more display segments along the first path that share the first intersection are implicated. Analogously, the second payout modifier may be positioned on a second intersection of three or more display segments along the second path for each of the gaming events of the second succession, and the three or more display segments along the second path that share the second intersection are implicated. In another embodiment, the first payout modifier is positioned on an adjoining boundary of a plurality of the display segments to create a first area of influence, which is applied to payouts occurring on the paylines where the payline passes through any of the first area of influence. Analogously, the second payout modifier may be positioned on an adjoining boundary of a plurality of the display segments to create a second area of influence, which is applied to payouts occurring on the paylines where the payline passes through any of the second area of influence.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A gaming device for playing a poker game, comprising:

a display configured to present a plurality of poker hands each having a plurality of cards presented at respective card positions;

a user interface configured to at least enable player interaction with the poker game; and a processor configured to:

randomly select cards, and cause the display to visually present the selected cards in the card positions of the plurality of poker hands;

randomly identify a payout enhancement, and cause the display to visually present the payout enhancement on a border of at least two adjacent ones of the presented card positions;

determine winning combinations of cards presented via the display and any respective payouts for each of the plurality of poker hands that implicate at least one of the presented card positions; and increase the payout for the poker hands that implicate at least one of the at least two adjacent presented card positions by an amount specified by the visually presented payout enhancement.

2. The gaming device of claim 1, wherein the processor is further configured to move the payout enhancement to a new position along a path in the plurality of poker hands on successive ones of the poker games, to newly identify at least two adjacent ones of the presented card positions on the successive ones of the poker games.

3. The gaming device of claim 1, wherein the payout enhancement comprises a multiplier value, and wherein the processor is further configured to:

present one or more additional multiplier values respectively identifying at least two adjacent ones of the presented card positions;

modify the payout for each of the poker hands that implicate at least one of the presented card positions by an amount specified by the respective additional multiplier value; and move each of the multiplier value and the one or more additional multiplier values on respective paths on each successive one of the poker games.

4. The gaming device of claim 3, wherein the processor is further configured to create a new multiplier value if the multiplier value and the one or more additional multiplier values intersect as they are moved on their respective paths, and wherein the processor is configured to increase the payout for the poker hands that implicate the presented card positions on which the multiplier value and the one or more additional multiplier values intersect by an amount specified by the new multiplier value.

5. The gaming device of claim 1, wherein the processor is further configured to:

provide the cards in a face-up orientation for a first of the plurality of poker hands;

receive player input via the user interface identifying any cards to be held in the first of the plurality of poker hands;

replicating the cards held in the first of the plurality of poker hands into corresponding ones of the card positions in remaining ones of the plurality of poker hands;

providing replacement cards for cards not held in the first of the plurality of poker hands where the cards were not replicated in the remaining ones of the plurality of poker hands; and wherein the processor determines the winning combinations of cards presented via the display and any respective payouts for each of the plurality of poker hands that implicate at least one of the presented card positions based on the poker hands after the cards held in the first of the plurality of poker hands are replicated into the remaining ones of the plurality of poker hands and the replacement cards are provided in the first and remaining plurality of poker hands.

6. The gaming device of claim 1, wherein the processor is further configured to:

determine winning combinations of cards presented via the display and any respective payouts for each of the plurality of poker hands that does not implicate at least one of the presented card positions; and provide a non-enhanced payout for the poker hands that do not implicate at least one of the at least two adjacent presented card positions.

7. The gaming device of claim 1, wherein the processor is further configured to cause the display to visually present the payout enhancement on an intersection of four adjacent ones of the presented card positions, and to increase the payout for the poker hands that implicate at least one of the four adjacent presented card positions by the visually presented payout enhancement.

8. The gaming device of claim 1, wherein the processor is further configured to cause the display to visually present an additional payout enhancement respectively identifying at least two adjacent ones of the presented card positions, and to increase the payout for the poker hands that implicate at least one of the identified adjacent ones of the presented card positions by an amount specified by the respective additional payout enhancement.

9. The gaming device of claim 8, wherein the processor is further configured to move the additional payout enhancement to new positions along an additional path through the plurality of poker hands on successive ones of the poker games, to newly identify at least two adjacent ones of the presented card positions on each of the successive ones of the poker games in which to increase the payout for the poker hands that implicate at least one of the at least two adjacent presented card positions by an amount specified by the additional payout enhancement.

10. A gaming device for playing a plurality of poker games, comprising:

a display configured to present a plurality of poker hands each having a plurality of cards presented at respective card positions for each of the plurality of poker games;

a user interface configured to at least enable player interaction with the poker games; and a processor configured to:

randomly select cards for a first poker game, and cause the display to visually present the selected cards in the card positions of a first plurality of poker hands;

randomly select one of the card positions of the first plurality of poker hands in which to initiate a payout enhancement, and cause the display to visually present the payout enhancement in connection with the randomly selected one of the card positions of the first plurality of poker hands;

utilize the payout enhancement to determine results for each of the first plurality of poker hands that implicate the randomly selected one of the card positions presenting the payout enhancement;

initially retain the payout enhancement at the randomly selected one of the card positions for a second poker game;

randomly select cards for the second poker game, and cause the display to visually present the selected cards in the card positions of a second plurality of poker hands;

move the payout enhancement from its card position in the first poker game to a second card position along a path of the card positions, and cause the display to visually present the payout enhancement in connection with the second card position; and utilize the payout enhancement to determine results for each of the second plurality of poker hands that implicate the second card position presenting the payout enhancement.

11. The gaming device of claim 10, wherein the processor is further configured to:

initially retain the payout enhancement at the second card position for a third poker game;

randomly select cards for the third poker game, and cause the display to visually present the selected cards in the card positions of a third plurality of poker hands;

move the payout enhancement from its card position in the second poker game to a third card position along the path of the card positions, and cause the display to visually present the payout enhancement in connection with the third card position; and utilize the payout enhancement to determine results for each of the third plurality of poker hands that implicate the third card position presenting the payout enhancement.

12. The gaming device of claim 10, wherein the processor is further configured to:

(a) initially retain the payout enhancement at its current card position for a subsequent poker game;

(b) randomly select cards for the subsequent poker game, and cause the display to visually present the selected cards in the card positions of a corresponding plurality of poker hands;

(c) move the payout enhancement from its current card position to a new card position along the path of the card positions, and cause the display to visually present the payout enhancement in connection with the new card position;

(d) utilize the payout enhancement to determine results for each of the corresponding plurality of poker hands that implicate the new card position presenting the payout enhancement; and (e) repeat (b)-(d) until a terminating condition occurs.

13. The gaming device of claim 12, wherein the processor is further configured to:

randomly select one of the card positions of the first plurality of poker hands in which to initiate a payout enhancement on an external border of an array of the card positions formed by the plurality of poker hands; and repeat (b)-(d) until the terminating condition occurs, involving the payout enhancement moving on successive ones of the plurality of poker games until the payout enhancement reaches an end of the path of the card positions.

14. The gaming device of claim 12, wherein the processor is further configured to:

randomly select one of the card positions of the first plurality of poker hands in which to initiate a payout enhancement on an external border of an array of the card positions formed by the plurality of poker hands; and repeat (b)-(d) until the terminating condition occurs, involving the payout enhancement moving from the randomly selected one of the card positions on the external border of the array to one of the card positions on an opposite external border of the array on successive ones of the plurality of poker games.

15. The gaming device of claim 10, wherein the payout enhancement comprises a payout multiplier, and wherein utilizing the payout enhancement to determine results comprises multiplying the payout multiplier by any payouts resulting from each of the plurality of poker hands that implicate the card positions on which the payout multiplier is visually presented.

16. The gaming device of claim 15, wherein the processor is further configured to determine the results for each of the first and second pluralities of poker hands that do not implicate the payout enhancement, and to provide a non-enhanced payout for the first and second plurality of poker hands that do not implicate the payout enhancement.

17. The gaming device of claim 10, wherein the payout enhancement comprises a wild symbol, and wherein utilizing the payout enhancement to determine results comprises determining winning combinations of cards presented via the display for each of the plurality of poker hands that implicates the card positions on which the wild symbol is visually presented.

18. A gaming device for playing a plurality of poker games, comprising:

a display configured to present a plurality of poker hands each having a plurality of cards presented at respective card positions for each of the plurality of poker games;

a user interface configured to at least enable player interaction with the poker games; and a processor configured to:

randomly select cards for a first poker game, and cause the display to visually present the selected cards in the card positions of a first plurality of poker hands;

randomly select one of the card positions of the first plurality of poker hands in which to initiate a first wild symbol, and cause the display to visually present the first wild symbol in connection with the randomly selected one of the card positions of the first plurality of poker hands;

determine winning combinations of cards presented via the display using the first wild symbol for each of the first plurality of poker hands that implicate the randomly selected one of the card positions presenting the first wild symbol;

initially retain the first wild symbol at the randomly selected one of the card positions for a second poker game;

randomly select cards for the second poker game, and cause the display to visually present the selected cards in the card positions of a second plurality of poker hands;

move the first wild symbol from its card position in the first poker game to a second card position along a first path of the card positions, and cause the display to visually present the first wild symbol in connection with the second card position; and determine winning combinations of cards presented via the display using the first wild symbol for each of the second plurality of poker hands that implicate the second card position presenting the first wild symbol.

19. The gaming device of claim 18, wherein the processor is further configured to:

(a) initially retain the first wild symbol at its current card position for a subsequent poker game;

(b) randomly select cards for the subsequent poker game, and cause the display to visually present the selected cards in the card positions of a corresponding plurality of poker hands;

(c) move the first wild symbol from its current card position to a new card position along the first path of the card positions, and cause the display to visually present the first wild symbol in connection with the new card position;

(d) utilize the first wild symbol to determine results for each of the corresponding plurality of poker hands that implicate the new card position presenting the first wild symbol; and (e) repeat (b)-(d) until a terminating condition occurs.

20. The gaming device of claim 19, wherein the processor is further configured to enable a second wild symbol to be moved along a second path over a plurality of the poker games that overlaps with the plurality of poker games in which the first wild symbol is moved along the first path.

* * * * *